US012624927B1

(12) United States Patent
Eichenblatt

(10) Patent No.: US 12,624,927 B1
(45) Date of Patent: May 12, 2026

(54) BOLTLESS VIEWPORT ASSEMBLY FOR A BALLISTIC SHIELD

(71) Applicant: Ambitec Inc., Miami Beach, FL (US)

(72) Inventor: Eliyahu Eichenblatt, Miami Beach, FL (US)

(73) Assignee: Ambitec Inc., Miami Beach, FL (US)

( * ) Notice: Subject to any disclaimer, the term of this patent is extended or adjusted under 35 U.S.C. 154(b) by 39 days.

(21) Appl. No.: 18/907,890

(22) Filed: Oct. 7, 2024

(51) Int. Cl.
*F41H 5/08* (2006.01)

(52) U.S. Cl.
CPC ..... *F41H 5/08* (2013.01)

(58) Field of Classification Search
CPC ..... F41H 5/08; F41H 5/013; F41H 5/0407; F41H 5/26
See application file for complete search history.

(56) References Cited

U.S. PATENT DOCUMENTS 2,316,055 A 4/1943 Davey
3,745,938 A * 7/1973 Hathaway ..... F41H 5/08 2/2.5
4,245,546 A 1/1981 Chaires
4,674,394 A * 6/1987 Martino ..... F41H 5/08 2/2.5
5,850,052 A * 12/1998 Gabriel ..... F41H 5/08 2/2.5
6,000,347 A * 12/1999 Madden, Jr. ..... A45C 15/00 109/22
6,807,890 B1 * 10/2004 Fuqua ..... F41H 5/08 89/36.02
7,716,748 B2 5/2010 Dovner
8,011,146 B2 9/2011 Krause
8,088,462 B1 1/2012 Cockman et al.
(Continued)

FOREIGN PATENT DOCUMENTS

CN 203837587 9/2014
CN 212205826 12/2020
(Continued)

OTHER PUBLICATIONS

Safariland, "Safariland Introduces Foxfury Integrated Light/Handle for Its Patented X Series Ballistic Shields," retrieved at https://inside.safariland.com/news/safariland-introduces-foxfury-integrated-light-handle-patented-x-series-ballistic-shields/ on Jun. 27, 2024.
(Continued)

*Primary Examiner* — Joshua E Freeman
(74) *Attorney, Agent, or Firm* — Hartman & Citrin LLC

(57) ABSTRACT

A boltless viewport assembly for a ballistic shield can include a piece of ballistic glass; a body side viewport retention sleeve, a ballistic glass holder sleeve, and a strike face side ballistic glass holder retention sleeve. The body side viewport retention sleeve can include a body side flange and an aperture insertion portion. The ballistic glass holder sleeve can include an aperture sleeve portion and a ballistic glass nest portion. The strike face side ballistic glass holder retention sleeve can include a strike face side flange. The ballistic glass can be placed in the ballistic glass holder sleeve, and the body side viewport retention sleeve can be attached to the ballistic glass holder sleeve. The strike face side ballistic glass holder retention sleeve can be attached to the ballistic glass holder sleeves.

20 Claims, 27 Drawing Sheets

(56) References Cited

U.S. PATENT DOCUMENTS

| | | | | |
|---|---|---|---|---|
| 8,276,498 | B1 | 10/2012 | Hannibal et al. | |
| 8,382,191 | B2 | 2/2013 | Hafften et al. | |
| 8,905,460 | B2 | 12/2014 | McCarthy et al. | |
| 9,267,764 | B2 * | 2/2016 | Seabrook | F41H 5/0478 |
| 9,347,748 | B1 | 5/2016 | Crisp | |
| 10,180,308 | B2 | 1/2019 | Lang et al. | |
| 10,288,387 | B1 * | 5/2019 | Marcum | F41H 5/08 |
| 11,428,507 | B2 | 8/2022 | Rasico et al. | |
| 11,498,396 | B1 | 11/2022 | Justice | |
| D1,071,338 | S * | 4/2025 | Bostwick | D29/100 |
| 12,326,240 | B1 * | 6/2025 | Wells | F21V 19/0035 |
| 2004/0144243 | A1 * | 7/2004 | Newkirk | F41H 5/26 89/36.01 |
| 2007/0283477 | A1 * | 12/2007 | Dovner | F41H 9/10 2/2.5 |
| 2012/0006453 | A1 * | 1/2012 | Clayton | F41H 5/08 150/154 |
| 2018/0120064 | A1 * | 5/2018 | Lang | F41H 5/08 |
| 2024/0044620 | A1 | 2/2024 | Oostvogel | |
| 2024/0093974 | A1 * | 3/2024 | Taylor | F41H 5/013 |

FOREIGN PATENT DOCUMENTS

| | | |
|---|---|---|
| CN | 219015113 | 5/2023 |
| EP | 3985344 | 4/2022 |

OTHER PUBLICATIONS

MDC, "Phalanx Shield, 26"×36", With Viewport, No Light, Level IIIA+ Tactical Shield Series," retrieved at https://www.mdcharlton.ca/product_details.php?pid=POSHIELD-PHALANX-SHLS30ACVQ on Jun. 27, 2024.

Incident Control Systems, "Ballistic Shields," retrieved at https://incidentcontrolsystems.com/ballistic-shields/ on Jun. 27, 2024.

MDC, "Aspis-X Gen II Shield, 20"×30", With Viewport, No Light, Level III," retrieved at https://www.mdcharlton.ca/product_details.php?pid=POSHIELD-SH3OASG2V1H2L0 on Jun. 29, 2024.

MDC, "Bellator Shield, 24"×36", With Viewport, with Light Level IIIA+," retrieved at https://www.mdcharlton.ca/product_details.php?pid=POSHIELD-BELLATOR-24X36-LK on Jun. 29, 2024.

* cited by examiner

BOLTLESS VIEWPORT ASSEMBLY FOR A BALLISTIC SHIELD

TECHNICAL FIELD

The present disclosure relates generally to firearms and weapons technologies. More particularly, the present disclosure relates to a boltless viewport assembly for a ballistic shield and/or other applications.

BACKGROUND

Unless otherwise indicated herein, all disclosures in the background are not prior art to the claims in this application and are not admitted to be prior art by inclusion in this section.

Ballistic shields, also known as bulletproof shields, can include protective devices that can be designed to absorb and/or deflect bullets and/or other projectiles. Ballistic shields may be used by law enforcement, military personnel, security forces, and/or private parties to provide protection from ballistic threats.

Ballistic shields can be formed from steel, ceramic, and/or other materials and may include lighting systems, viewing windows or viewports, handles, and/or other features. Generally speaking, these and other features must be bolted to the body of the ballistic shield or formed within the ballistic shield during manufacturing.

SUMMARY

The present disclosure is directed to a boltless viewport assembly for a ballistic shield or other structure such as a barrier, wall, vehicle structure (e.g., a door), or the like. Embodiments of the boltless viewport assembly for a ballistic shield illustrated and described herein can be formed from at least two components that can be assembled to a shield body of a ballistic shield to avoid the use of bolts, rivets, screws, welds, and/or some other connection mechanisms (e.g., fastening and/or binding mechanisms or the like). In some embodiments of the concepts and technologies disclosed herein, adhesives may be used, while in some other embodiments, the boltless viewport assembly can be assembled using adhesives such as an epoxy or other resin, glues, or the like. In some embodiments of the concepts and technologies disclosed herein, the boltless viewport assembly can include a body side viewport retention sleeve and a ballistic glass holder sleeve. A piece of ballistic glass or other bulletproof or bullet resistant material (e.g., polycarbonate, transparent polyethylene composite(s), glass-fiber and/or carbon fiber reinforced polycarbonate, acrylic(s), high pressure pressed (e.g., hydraulic pressed and/or industrial pressed) composite materials, one or more laminated layers, combinations thereof, or the like) can be located in the ballistic glass holder sleeve, and the body side viewport retention sleeve can be inserted into and/or mated with the ballistic glass holder sleeve to join the boltless viewport assembly to the shield body.

In some contemplated embodiments, the ballistic glass or other bulletproof or bullet resistant material can be replaced with a camera and display (e.g., a digital display, which can optionally include lighting devices, thermal devices, night vision, and/or the like) in some embodiments to provide a virtual viewport, with the digital display and/or other components being housed in the boltless viewport assembly illustrated and described herein. In some embodiments of the concepts and technologies disclosed herein, the boltless viewport assembly can further include a strike face side ballistic glass holder retention sleeve, which can be further assembled to the ballistic glass holder sleeve to retain the ballistic glass and ballistic glass holder sleeve in a desired configuration relative to the shield body.

In some embodiments, the ballistic shield illustrated and described herein can be formed from at least four components that can be assembled to a shield body of a ballistic shield without bolts, rivets, screws, welds, and/or other connection mechanisms. In particular, the boltless viewport assembly can include a body side viewport retention sleeve, ballistic glass holder sleeve, a piece of ballistic glass or other bulletproof or bullet resistant material, and strike face side ballistic glass holder retention sleeve. The ballistic glass can be located inside a portion of the ballistic glass holder sleeve and the ballistic glass holder sleeve can be inserted into a viewport aperture formed in the shield body from a strike face of the shield body.

The body side viewport retention sleeve can be located on the body side of the shield body and the ballistic glass holder sleeve can be located on a strike face side of the shield body. A portion of the body side viewport retention sleeve can be inserted into and/or through the viewport aperture from a body side of the shield body and into a portion of the ballistic glass holder sleeve. A portion of the ballistic glass holder sleeve can be inserted into the shield body from the strike face side of the shield body. Features of the body side viewport retention sleeve and the ballistic glass holder sleeve can be mated together, thereby creating a backbone of sorts for the boltless viewport assembly.

A strike face side ballistic glass holder retention sleeve can be assembled to the ballistic glass holder sleeve from the strike face side of the shield body to cover and/or retain the ballistic glass and ballistic glass holder sleeve in a desired configuration relative to the shield body. In some embodiments, the body side viewport retention sleeve, the ballistic glass holder sleeve, and the strike face side ballistic glass holder retention sleeve can use complimentary and/or reciprocal snap fit connectors or other mechanisms such as ribs and grooves, interference fits, interlocking joints, or the like. Thus, components of the boltless viewport assembly can be assembled to one another in a permanent or semi-permanent manner without bolts, rivets, screws, or the like. It should be understood that this example embodiment is illustrative, and therefore should not be construed as being limiting in any way.

According to one embodiment of the concepts and technologies disclosed herein, a ballistic shield can include a boltless viewport assembly. The ballistic shield can include a shield body having a body side and a strike face side, and the shield body can have a viewport aperture formed therethrough. The boltless viewport assembly can include a piece of ballistic glass and a body side viewport retention sleeve including a body side flange and an aperture insertion portion that is configured to be inserted into the viewport aperture from the body side of the shield body. The boltless viewport assembly can further include a ballistic glass holder sleeve including an aperture sleeve portion and a ballistic glass nest portion configured to receive the piece of ballistic glass. The aperture sleeve portion can be configured to be inserted into the viewport aperture from the strike face side of the shield body. The boltless viewport assembly can further include a strike face side ballistic glass holder retention sleeve that can include a strike face side flange.

In some embodiments, the aperture insertion portion of the body side viewport retention sleeve can include one or more aperture insertion portion snap fit projections that can be configured to mate with aperture sleeve portion snap fit projections formed on the ballistic glass holder sleeve to attach the body side viewport retention sleeve and the ballistic glass holder sleeve to the shield body. In some embodiments, the ballistic glass nest portion of the ballistic glass holder sleeve can include ballistic glass nest portion grooves formed on an outer surface of the ballistic glass holder sleeve. The ballistic glass nest portion grooves can be configured to mate with glass holder nesting portion snap fit projections formed on an inside surface of the strike face side ballistic glass holder retention sleeve to attach the strike face side ballistic glass holder retention sleeve to the ballistic glass holder sleeve.

In some embodiments, the body side flange can be located on the body side of the shield body. In some embodiments, the strike face side flange can be located on the strike face side of the shield body. In some embodiments, the ballistic glass holder sleeve can include a strike side support flange and the strike side support flange can be configured to support the piece of ballistic glass in cooperation with a ballistic glass support area of the shield body. In some embodiments, the boltless viewport assembly can be assembled to the shield body without bolts, without welding, and without screws.

According to one embodiment of the concepts and technologies disclosed herein, a ballistic shield can include a boltless viewport assembly. The ballistic shield can include a shield body having a body side and a strike face side, and the shield body can have a viewport aperture formed therethrough. The boltless viewport assembly can include a piece of ballistic glass and a body side viewport retention sleeve including a body side flange and an aperture insertion portion that is configured to be inserted into the viewport aperture from the body side of the shield body. The boltless viewport assembly can further include a ballistic glass holder sleeve including an aperture sleeve portion and a ballistic glass nest portion configured to receive the piece of ballistic glass. The aperture sleeve portion can be configured to be inserted into the viewport aperture from the strike face side of the shield body. The boltless viewport assembly can further include a strike face side ballistic glass holder retention sleeve that can include a strike face side flange. The body side viewport retention sleeve can be configured to connect to the ballistic glass holder sleeve, and the strike face side ballistic glass holder retention sleeve can be configured to connect to the ballistic glass holder sleeve.

In some embodiments, the aperture insertion portion of the body side viewport retention sleeve can include one or more aperture insertion portion snap fit projections that can be configured to mate with aperture sleeve portion snap fit projections formed on the ballistic glass holder sleeve to attach the body side viewport retention sleeve and the ballistic glass holder sleeve to the shield body. In some embodiments, the ballistic glass nest portion of the ballistic glass holder sleeve can include ballistic glass nest portion grooves formed on an outer surface of the ballistic glass holder sleeve. The ballistic glass nest portion grooves can be configured to mate with glass holder nesting portion snap fit projections formed on an inside surface of the strike face side ballistic glass holder retention sleeve to attach the strike face side ballistic glass holder retention sleeve to the ballistic glass holder sleeve.

In some embodiments, the body side flange can be located on the body side of the shield body. In some embodiments, the strike face side flange can be located on the strike face side of the shield body. In some embodiments, the ballistic glass holder sleeve can include a strike side support flange and the strike side support flange can be configured to support the piece of ballistic glass in cooperation with a ballistic glass support area of the shield body. In some embodiments, the boltless viewport assembly can be assembled to the shield body without bolts, without welding, and without screws.

According to one embodiment of the concepts and technologies disclosed herein, a ballistic shield can include a boltless viewport assembly. The ballistic shield can include a shield body having a body side and a strike face side, and the shield body can have a viewport aperture formed therethrough. The boltless viewport assembly can include a piece of ballistic glass and a body side viewport retention sleeve including a body side flange and an aperture insertion portion that is configured to be inserted into the viewport aperture from the body side of the shield body. The boltless viewport assembly can further include a ballistic glass holder sleeve including an aperture sleeve portion and a ballistic glass nest portion configured to receive the piece of ballistic glass. The aperture sleeve portion can be configured to be inserted into the viewport aperture from the strike face side of the shield body. The boltless viewport assembly can further include a strike face side ballistic glass holder retention sleeve that can include a strike face side flange. The body side viewport retention sleeve can be configured to connect to the ballistic glass holder sleeve, and the strike face side ballistic glass holder retention sleeve can be configured to connect to the ballistic glass holder sleeve. The boltless viewport assembly can be configured to be assembled without bolts, without welding, and without screws.

In some embodiments, the aperture insertion portion of the body side viewport retention sleeve can include one or more aperture insertion portion snap fit projections that can be configured to mate with aperture sleeve portion snap fit projections formed on the ballistic glass holder sleeve to attach the body side viewport retention sleeve and the ballistic glass holder sleeve to the shield body. In some embodiments, the ballistic glass nest portion of the ballistic glass holder sleeve can include ballistic glass nest portion grooves formed on an outer surface of the ballistic glass holder sleeve. The ballistic glass nest portion grooves can be configured to mate with glass holder nesting portion snap fit projections formed on an inside surface of the strike face side ballistic glass holder retention sleeve to attach the strike face side ballistic glass holder retention sleeve to the ballistic glass holder sleeve.

In some embodiments, the body side flange can be located on the body side of the shield body. In some embodiments, the strike face side flange can be located on the strike face side of the shield body. In some embodiments, the ballistic glass holder sleeve can include a strike side support flange and the strike side support flange can be configured to support the piece of ballistic glass in cooperation with a ballistic glass support area of the shield body. In some embodiments, the boltless viewport assembly can be assembled to the shield body without bolts, without welding, and without screws.

DETAILED DESCRIPTION

Figure 1:
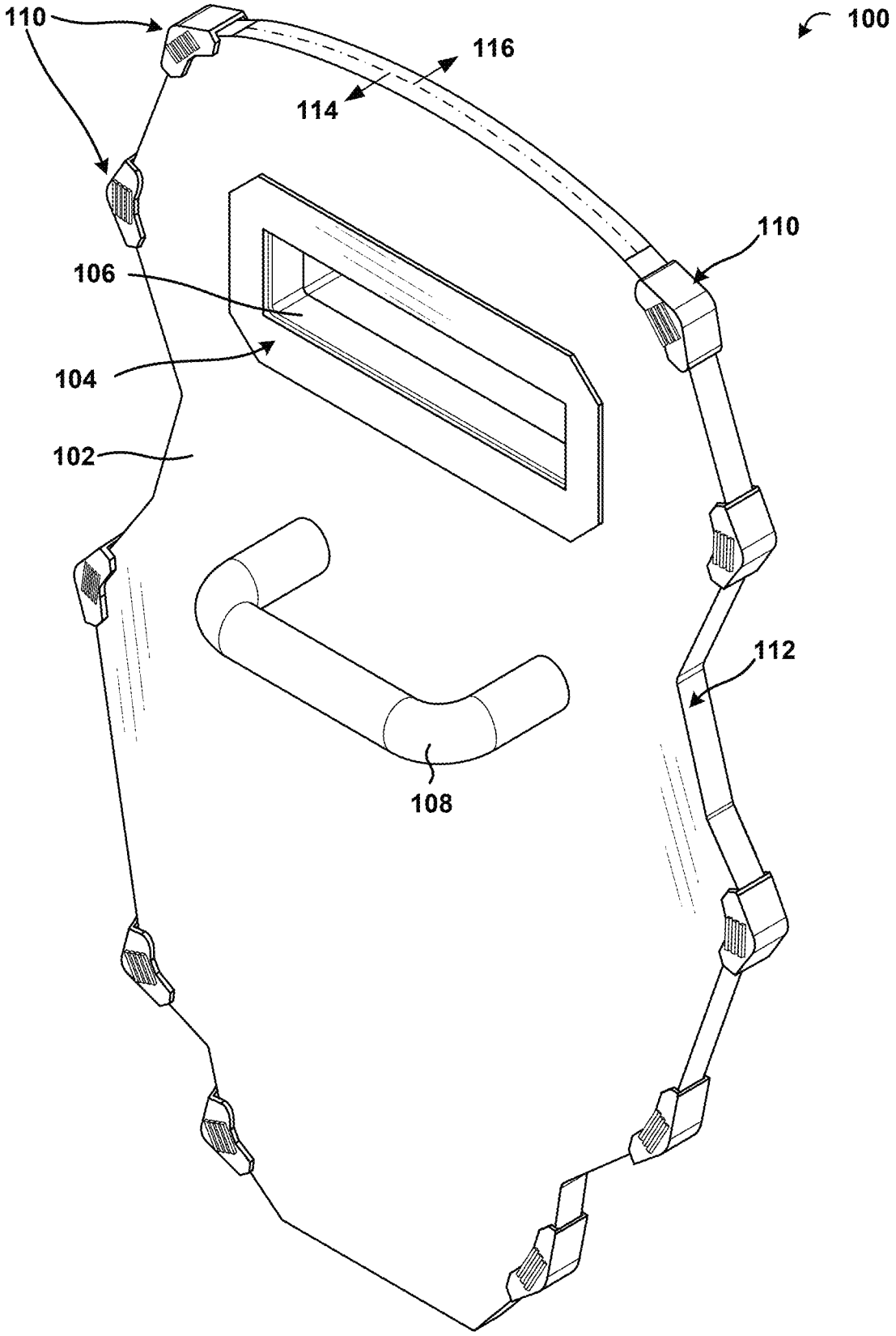
FIG. 1 is a line drawing illustrating a perspective view of a body side of a ballistic shield having a boltless viewport, according to an illustrative embodiment of the concepts and technologies disclosed herein.

In the following detailed description, references are made to the accompanying drawings that form a part hereof and that show, by way of illustration, specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model, sample, or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a boltless viewport assembly for a ballistic shield will be described.

Referring first to FIG. 1, a ballistic shield 100 is illustrated, according to an example embodiment of the concepts and technologies disclosed herein. The ballistic shield 100 can include a shield body 102. The shield body 102 can be formed, in various embodiments, from a bulletproof and/or bullet resistant material such as, for example, steel, ceramic, and/or other materials. The steel, ceramic, and/or other materials also can be coated in various embodiments with other materials such as polyurea, woven fabrics and/or aramids, paints, or the like. In some embodiments, for example, the shield body 102 can be formed from a member of the SSAB® HARDOX® family of steels (e.g., the SSAB® HARDOX® 600 brand steel); other abrasion resistant steels (e.g., AR600 steel, AR500 steel, etc.); and/or other military-rated and/or non-military-rated ballistic steel.

According to various embodiments, the shield body 102 can be formed with various thicknesses. In some embodiments, the thickness can be included in a range of thicknesses from about 4.5 mm to about 7 mm. In some other embodiments, the thickness can be included in a range of thicknesses from about 0.1 mm to about 15 mm. In some embodiments, the shield body 102 can also be configured to accommodate ceramic plates and/or polyethylene in large format monolithic configurations and/or two-part and/or multi-part ceramic embedded in polyethylene solutions, as well as hybrid steel/polyethylene/ceramic solutions. Thus, it should be understood that the above thicknesses are illustrative and should not be construed as being limiting in any way. In the illustrated embodiment, the shield body 102 can include a steel plate having a thickness of 5 mm. In various embodiments of the concepts and technologies disclosed herein, the shield body 102 can be coated with polyurea and/or other materials. Because other thicknesses are possible and are contemplated, it should be understood that the above listed example steels and thicknesses are illustrative, and therefore should not be construed as being limiting in any way.

According to various embodiments, the shield body 102 can be formed as a flat and/or substantially planar shield body 102 (as illustrated in FIG. 1), or with non-planar shapes (e.g., with a curved or partially curved shape and/or other surface shapes and/or features, which are not visible in FIG. 1). In some embodiments, for example, the shield body 102 can be curved toward a user of the ballistic shield 100. It should be understood that this example embodiment is illustrative, and therefore should not be construed as being limiting in any way. Because other shapes of the shield body 102 are possible and are contemplated, it should be understood that the above listed shapes and/or features are illustrative, and therefore should not be construed as being limiting in any way.

As shown in FIG. 1, the ballistic shield 100 illustrated and described herein can include a boltless viewport assembly 104. The boltless viewport assembly 104 can be formed from two or more components that can be assembled to position, locate, hold, and/or retain one or more pieces of ballistic glass 106 in a location relative to an opening or aperture (not visible in FIG. 1) in the shield body 102, thereby creating a viewport for the ballistic shield 100. As used herein, the term "ballistic glass" can refer to glass and similar materials, crystal or similar materials (manmade or natural such as artificial sapphire), polycarbonate or other materials (e.g., polycarbonate, transparent polyethylene composite(s), glass-fiber and/or carbon fiber reinforced polycarbonate, acrylic(s), high pressure pressed (e.g., hydraulic pressed and/or industrial pressed) composite materials, one or more laminated layers, combinations thereof, or the like), other materials, and the like. As noted above, a digital display and camera can also be used in place of or in addition to the "ballistic glass" in some embodiments. As such, it should be understood that the ballistic glass 106 can include a clear material of various types that can be formed to be bullet resistant and/or bulletproof and/or one or more displays, cameras, or other devices or structures. It should be understood that this example embodiment is illustrative, and therefore should not be construed as being limiting in any way.

According to various embodiments of the concepts and technologies disclosed herein, the viewport created by the boltless viewport assembly 104 can provide a user of the ballistic shield with the ability to see on the other side of the ballistic shield 100, to engage targets on the other side of the ballistic shield 100, to navigate through spaces while being protected by the ballistic shield 100, combinations thereof, or the like. Additional details of the viewport will be illustrated and described hereinbelow.

According to various embodiments of the concepts and technologies disclosed herein, the components of the boltless viewport assembly 104 can be formed from one or more polymers such as, for example, polyamide, polyetherketone ("PEK"), polyetheretherketone ("PEEK"); one or more epoxies or phenolic resins; other thermoplastics; or the like. The components of the boltless viewport assembly 104 also can be created using a 3D printer, or the like, and therefore can be manufactured from plastics that can be reinforced with glass and/or carbon fibers, in some embodiments. Additionally, or alternatively, the components of the boltless viewport assembly 104 can be formed from other materials such as metals and/or alloys such as aluminum, steel, or the like. Thus, it can be appreciated that according to various embodiments of the concepts and technologies disclosed herein, the components of the boltless viewport assembly 104 can be formed via injection molding, stamping, machining, casting, extrusion, blow molding, thermoforming, compression molding, film casting, rotational molding, foaming, laser cutting, water jet cutting, plasma cutting, finishing (sandblasting, texturized molding, other finishing processes, or the like) and/or other processes. In some embodiments, the components of the boltless viewport assembly 104 can be formed by injection molding using materials such as polyamide, other than the ballistic glass 106, which can be formed from glass, polycarbonate, or other materials and/or substituted with a display, camera, or the like as explained hereinabove. It should be understood that these example embodiments are illustrative, and therefore should not be construed as being limiting in any way.

As noted above with reference to the shield body 102, it should be understood that one or more components of the boltless viewport assembly 104 can be curved or have other shapes or features that are not illustrated in FIG. 1. Thus, for example, if the shield body 102 is curved, it can be appreciated that one or more components of the boltless viewport assembly 104 may have similar shapes (e.g., a curved surface, or the like), configurations, features, or the like. An embodiment of the boltless viewport assembly 104 for use on a curved shield body 102 is illustrated and described below with reference to FIGS. 11A-11D. It should be understood that this example embodiment is illustrative, and therefore should not be construed as being limiting in any way.

The ballistic shield 100 also can include a handle 108. The handle 108 can be used by a user or other entity to carry and/or brace the ballistic shield 100. According to various embodiments of the concepts and technologies disclosed herein, the handle 108 can be formed from steel, aluminum, titanium, ceramic, wood, and/or other materials. In some embodiments, the handle 108 can include a steel structure that can be wrapped or otherwise coated with a soft compressible rubber or polymer such as neoprene or the like. It should be understood that this example embodiment is illustrative, and therefore should not be construed as being limiting in any way.

The ballistic shield 100 also can include one or more corner guards or corner protectors ("corner guards") 110. The corner guards 110 can be provided in some embodiments for decorative purposes. In some other embodiments, the corner guards 110 can be provided to protect one or more corners of the edge 112 of the ballistic shield 100. The edge 112 can be formed with one or more corners in some embodiments (such as the embodiment shown in FIG. 1) for decorative and/or functional purposes. The corner guards 110 can be included to prevent damage from the corners of the edge 112 in some embodiments and/or for decorative purposes. While the illustrated corner guards 110 are illustrated as including decorative ridges, it should be understood that this example embodiment is illustrative and that additional, alternative, and/or no decorative features may be included on the corner guards 110. Thus, it should be understood that this example embodiment is illustrative, and therefore should not be construed as being limiting in any way.

In various embodiments, the corner guards 110 can be formed from a rubber or polymer such as, for example, rubber, neoprene, or the like. In some other embodiments, the corner guards 110 can be formed from other materials such as, for example, acrylics, plastics, rubbers, elastomers, wood, metal, or the like. Because other materials can be used to form the corner guards 110, it should be understood that the above examples are illustrative and should not be construed as being limiting in any way.

As visible in FIG. 1, and as will be illustrated and described in more detail herein, the boltless viewport assembly 104 can include a body side 114, which can correspond to a side of the ballistic shield 100 that faces a user or carrier of the ballistic shield 100. The ballistic shield 100 also can include a strike face side 116, which can correspond to a side of the ballistic shield 100 that faces away from the user or carrier of the ballistic shield 100 and/or that faces or is exposed to a threat or target of the user or carrier in various embodiments. It should be understood that this example embodiment is illustrative, and therefore should not be construed as being limiting in any way.

Figure 2:
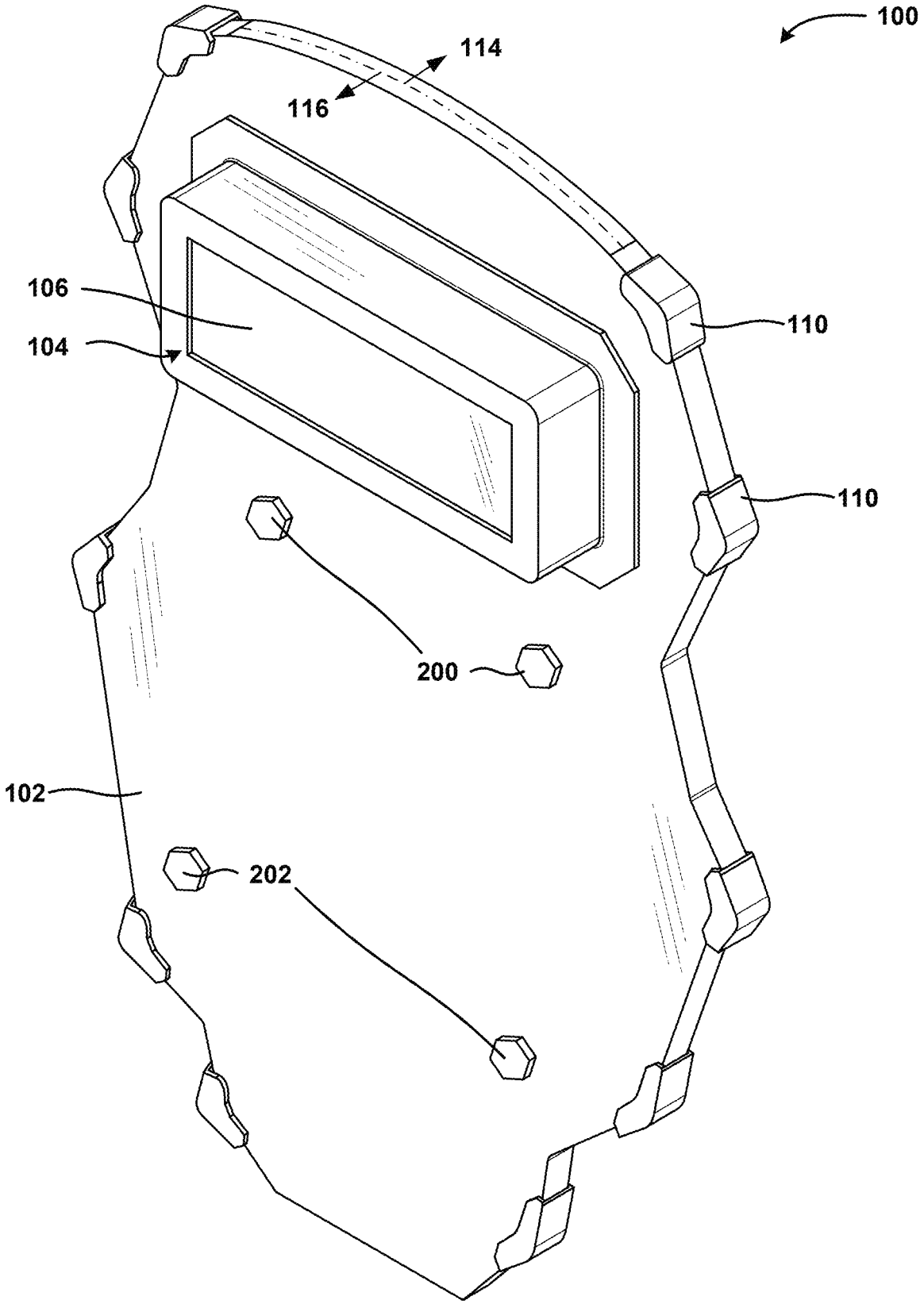
FIG. 2 is a line drawing illustrating a perspective view of a strike face side of the ballistic shield depicted in FIG. 1, according to an illustrative embodiment of the concepts and technologies disclosed herein.

With additional reference now to FIG. 2, the strike face side 116 of the ballistic shield 100 shown in FIG. 1 is illustrated, according to an example embodiment of the concepts and technologies disclosed herein. As can be seen in FIG. 2, the boltless viewport assembly 104 can project away from the shield body 102 on the strike face side 116 while on the body side 114, the boltless viewport assembly 104 may be substantially flush with the surface of the shield body 102. According to various embodiments of the concepts and technologies disclosed herein, this design, whereby the boltless viewport assembly 104 can be substantially flush on the body side 114 of the ballistic shield 100 and may project outwardly on the strike face side 116 of the ballistic shield 100, may be used to locate a majority of the volume of the boltless viewport assembly 104 on the strike face side 116 of the ballistic shield 100 to avoid interfering with movements of a user of the ballistic shield 100. It should be understood that this example embodiment is illustrative, and therefore should not be construed as being limiting in any way.

As visible in FIG. 2, the ballistic shield 100 also can include one or more bolts 200, which can be used in some embodiments to secure the handle 108 (visible in FIG. 1). As can be seen in FIG. 2, the bolts 200 can include a hex design in some embodiments. It should be understood that this example embodiment is illustrative, and therefore should not be construed as being limiting in any way. Additionally, the ballistic shield 100 can include decorative bolts 202 or other ornamental features. In some embodiments, such as the embodiment shown in FIG. 2, the decorative bolts 202 may be rivets, bolts, or the like and can be included for aesthetic purposes such as to compliment the bolts 200, for marketing purposes such as including logos or trademarks of a manufacturer, for other reasons, and/or for no particular reason. As such, it should be understood that the illustrated embodiment is illustrative and should not be construed as being limiting in any way.

As can be appreciated with collective reference to FIGS. 1-2, the ballistic shield 100 can include a viewport, which can be provided by the boltless viewport assembly 104. The viewport can enable a user to see what is on the strike face side 116 of the ballistic shield without exposing body parts (e.g., the head and eyes) from behind the protection of the ballistic shield, as generally is known. The boltless viewport assembly 104 of embodiments of the concepts and technologies disclosed herein can provide the viewport without requiring attachment mechanisms such as screws, rivets, bolts (e.g., the bolts 200), welding, or the like to hold the components of the boltless viewport assembly 104 together. In some embodiments, the boltless viewport assembly 104 can be assembled without adhesives, while in some other embodiments, connections between components of the boltless viewport assembly 104 can be reinforced with adhesives, or one or more components of the boltless viewport assembly 104 can be connected to the shield body 102 using one or more adhesives.

It can be appreciated that the use of bolts to hold together the components of the boltless viewport assembly 104 may require drilling one or more holes or apertures through one or more components of the boltless viewport assembly 104 such as, for example, the ballistic glass 106. A hole in ballistic glass 106 can create weak points and/or stress points that may subject the ballistic glass 106 to breakage and/or failure in some instances. Thus, embodiments of the concepts and technologies disclosed herein have eliminated the need for bolts or rivets and/or other attachment mechanisms. It should be understood that this example embodiment is illustrative, and therefore should not be construed as being limiting in any way.

Figure 3:
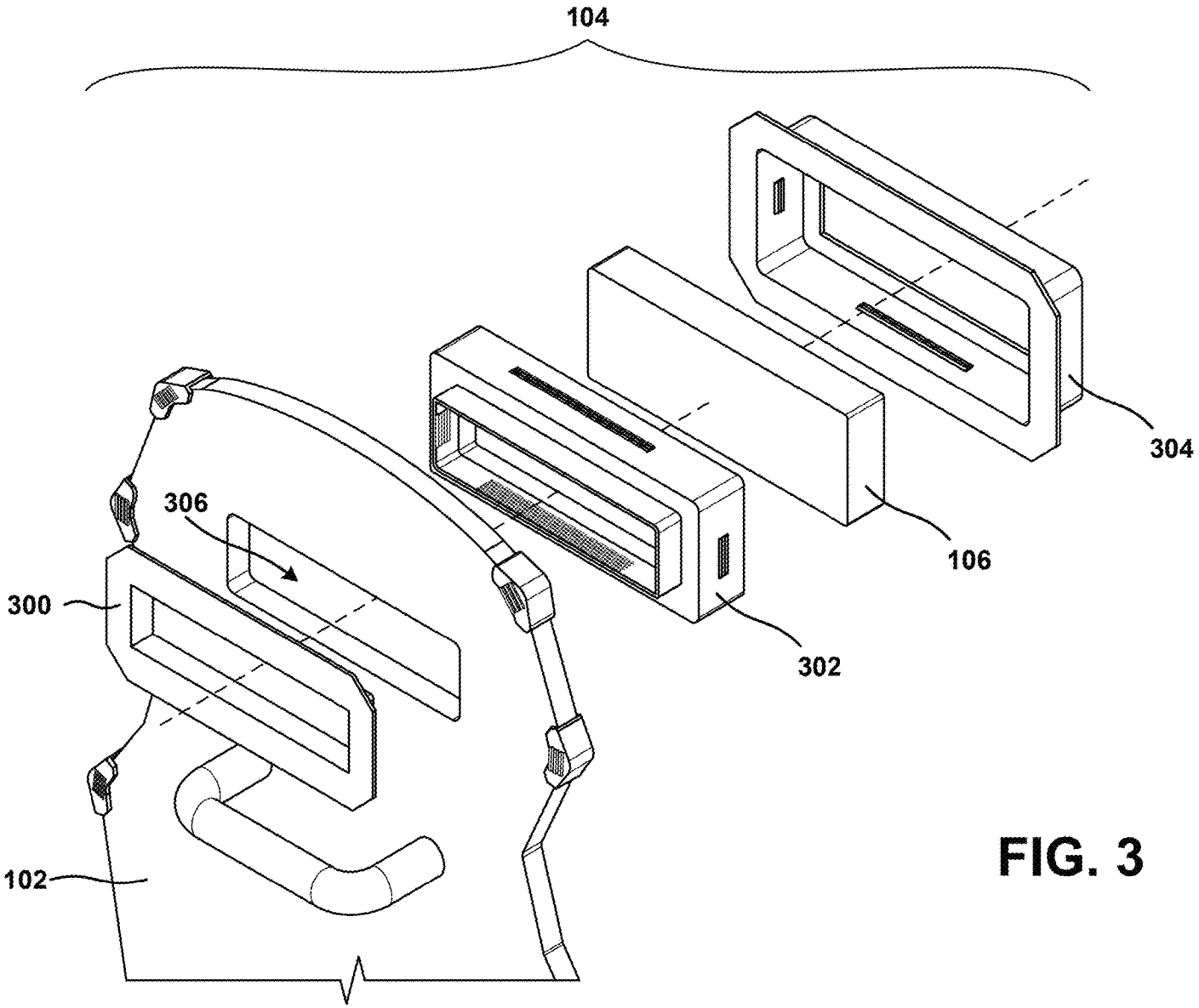
FIG. 3 is a line drawing illustrating an exploded assembly view of the boltless viewport assembly for the ballistic shield depicted in FIG. 1 as viewed from the body side of the ballistic shield, according to an illustrative embodiment of the concepts and technologies disclosed herein.

Turning now to FIG. 3, additional details of the boltless viewport assembly 104 will be illustrated in detail. In particular, FIG. 3 is a line drawing depicting an exploded assembly diagram of the components of the boltless viewport assembly 104 to a shield body 102. It should be understood that this example embodiment is illustrative, and therefore should not be construed as being limiting in any way.

Figure 4:
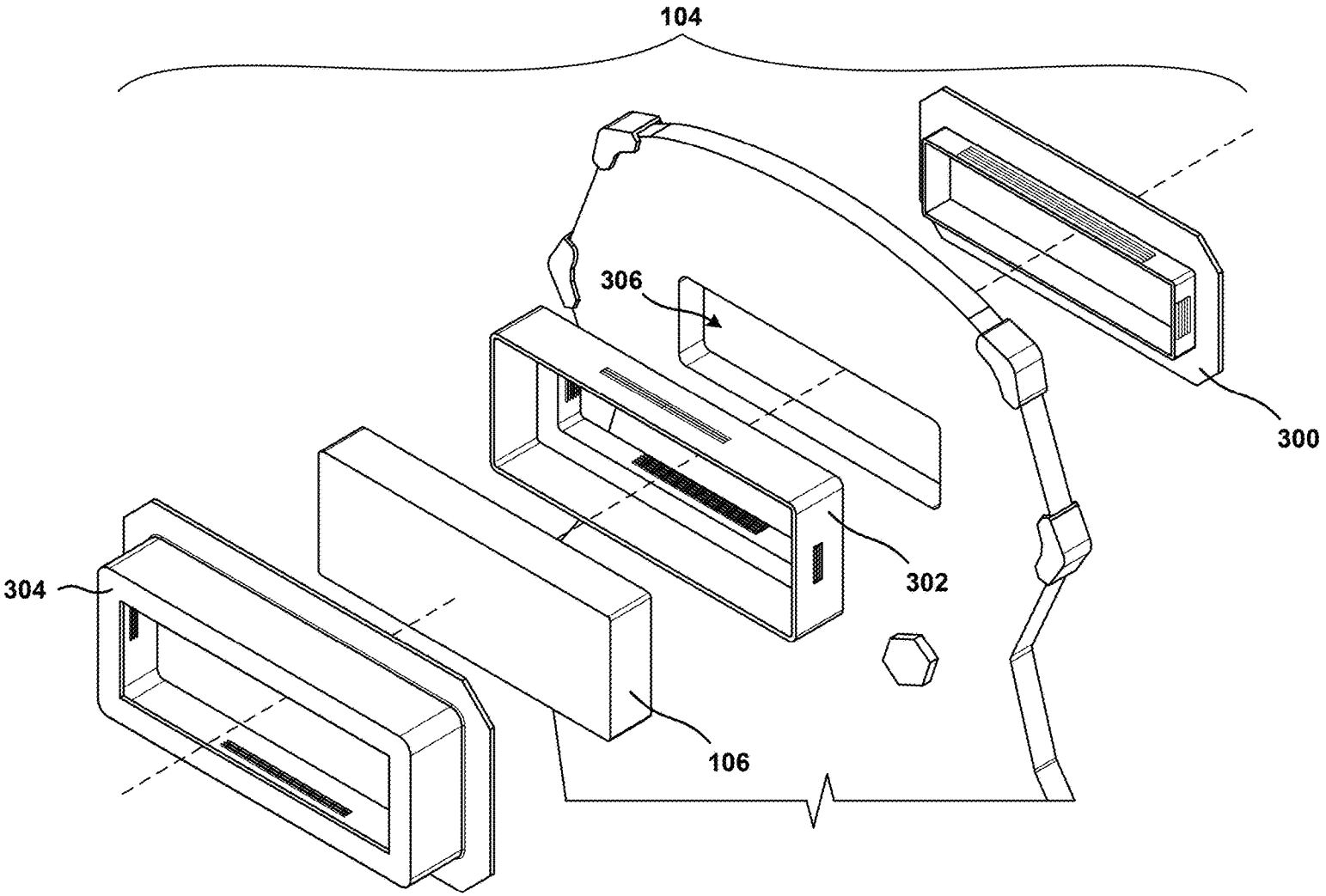
FIG. 4 is a line drawing illustrating an exploded assembly view of the boltless viewport assembly for the ballistic shield depicted in FIG. 2 as viewed from the strike face side of the ballistic shield, according to an illustrative embodiment of the concepts and technologies disclosed herein.

As shown in FIGS. 3-4, the boltless viewport assembly can include a body side viewport retention sleeve 300, a ballistic glass holder sleeve 302, the ballistic glass 106, and a strike face side ballistic glass holder retention sleeve 304. The shield body 102 can include a viewport aperture 306, which can correspond to a hole formed through the shield body 102 to enable a user to see from the body side 114 of the ballistic shield 100 to the strike face side 116 of the ballistic shield 100. As will be explained below, the ballistic glass 106 can be sized such that a portion of the ballistic glass 106 can be supported by an interior of the strike face side ballistic glass holder retention sleeve 304 (into which the ballistic glass can nest), and therethrough by an area of the shield body 102 that is adjacent to the viewport aperture 306. As such, it can be appreciated that the ballistic glass 106 can be supported by the shield body 102, thereby providing rigidity and strength to the boltless viewport assembly 104. It should be understood that this example embodiment is illustrative, and therefore should not be construed as being limiting in any way.

The assembly of the various components of the boltless viewport assembly 104 (e.g., the body side viewport retention sleeve 300, a ballistic glass holder sleeve 302, the ballistic glass 106, and a strike face side ballistic glass holder retention sleeve 304) will be better understood with reference to drawings below, in which these components will be illustrated and described in detail. Furthermore, the methods by which these components are assembled together will be better understood after illustrating and describing these components in detail in FIGS. 5A-8F.

Figure 5B:
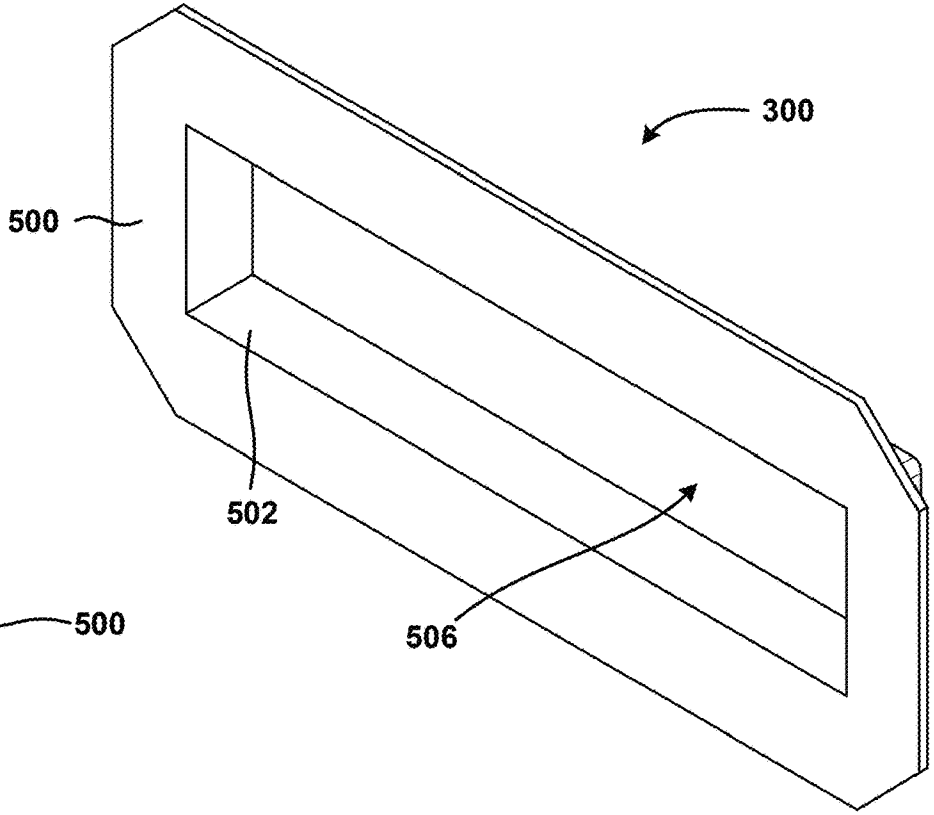
FIG. 5B is a line drawing illustrating a perspective view of the strike face side glass retention sleeve of a boltless viewport assembly as viewed from the strike face side, according to an illustrative embodiment of the concepts and technologies disclosed herein.
Figure 5A:
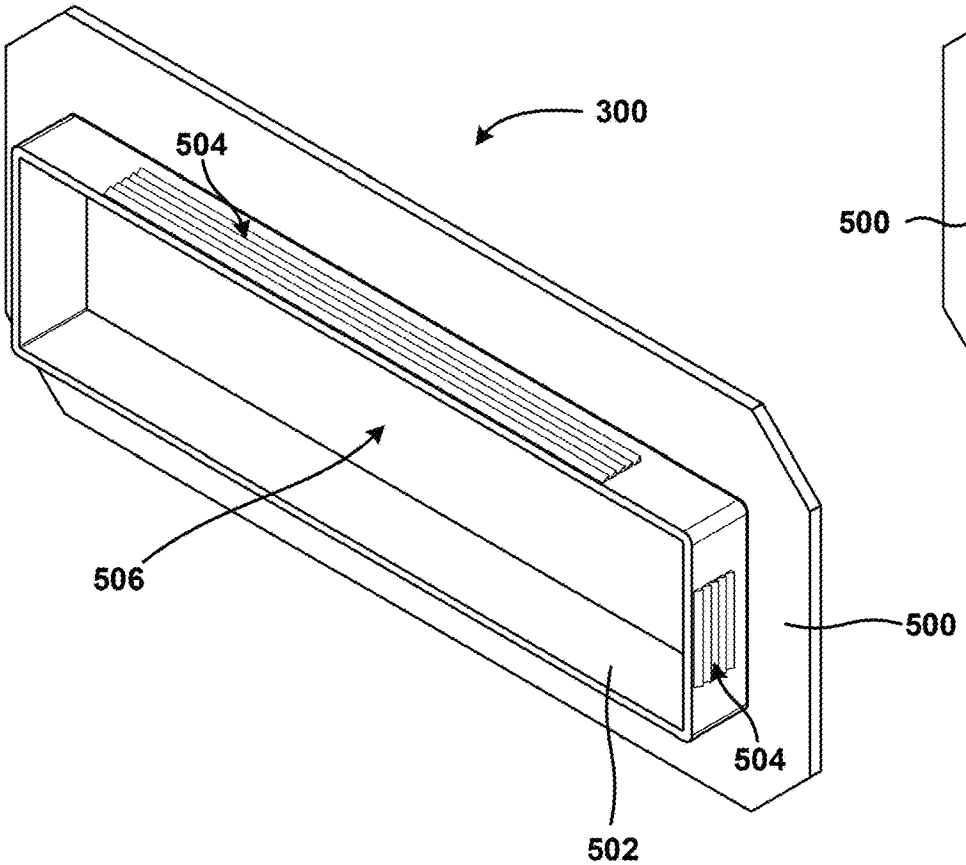
FIG. 5A is a line drawing illustrating a perspective view of the strike face side glass retention sleeve of a boltless viewport assembly as viewed from the body side, according to an illustrative embodiment of the concepts and technologies disclosed herein.

Turning now to FIGS. 5A-5F, the body side viewport retention sleeve 300 will be illustrated and described in detail. In particular, FIG. 5A is a perspective view of the body side viewport retention sleeve 300 from the side that contacts the shield body 102 (e.g., the strike face side of the body side viewport retention sleeve 300). As can be seen in FIG. 5A, the body side viewport retention sleeve 300 can include a body side flange 500. The body side flange 500 can be configured to extend over and overlap a portion of the shield body 102 on all four sides of the body side viewport retention sleeve 300. It can be appreciated with reference to FIG. 5A that the body side flange 500 can have a decorative or ornamental shape, though this is not necessarily the case in all embodiments. In the illustrated embodiment, the body side flange 500 is illustrated as having an irregular octagonal shape, wherein two of the sides have a first length, two of the sides have a second length, and four of the sides have a third length. In some embodiments, the irregular or stretched octagonal shape may be used in association with other octagonal elements (e.g., the bolts 200 and/or the decorative bolts 202 may include an octagonal shape in some embodiments). Because other shapes and/or dimensions for the body side flange 500 are possible and are contemplated, it should be understood that this embodiment is illustrative and should not be construed as being limiting in any way.

The body side viewport retention sleeve 300 also can include an aperture insertion portion 502. The aperture insertion portion 502 can have various shapes, configurations, and/or dimensions. In the illustrated embodiment, the aperture insertion portion 502 can have a substantially rectangularly-shaped configuration, which can be configured for insertion into and/or through the shield body 102 and/or one or more other components of the boltless viewport assembly 104. It should be understood that this example embodiment is illustrative, and therefore should not be construed as being limiting in any way.

The aperture insertion portion 502 can include one or more aperture insertion portion snap fit projections 504 on one or more sides of the aperture insertion portion 502. As used herein and in the claims, the phrase "snap fit projections" and/or "grooves" can be used to refer to various mechanical structures that can be used to mate two components such as posts and detents, ribs and grooves, hooks and loops, or other suitable structures. It should be understood that in some embodiments of the concepts and technologies disclosed herein, some and/or all of the snap fit projections and/or grooves of one or more of reciprocal components can be replaced with other connecting and/or binding mechanisms such as adhesives or other mechanisms illustrated and described herein. As such, the illustrated embodiments should be understood as being illustrative and should not be construed as being limiting in any way.

In the illustrated embodiment, each of four sides of the aperture insertion portion 502 can have one or more aperture insertion portion snap fit projections 504, which can extend along approximately two thirds of the length of the respective sides. It should be understood that this example embodiment is illustrative, and therefore should not be construed as being limiting in any way. It should be appreciated that additional aperture insertion portion snap fit projections 504 can be included on the two sides of the aperture insertion portion 502 that are not visible in FIG. 5A. It should be understood that this example embodiment is illustrative, and therefore should not be construed as being limiting in any way.

The aperture insertion portion 502 also can include an aperture insertion portion viewport aperture 506, which can be dimensioned and/or configured in various manners. In the illustrated embodiment, the aperture insertion portion viewport aperture 506 can be configured and/or dimensioned to be approximately equal in size and dimensions as the viewport aperture 306 of the shield body 102. Thus, it can be appreciated that the aperture insertion portion viewport aperture 506 and the viewport aperture 306 can cooperate to enable a user and/or other entity to look through the aperture insertion portion 502 and the viewport aperture 306. It should be understood that this example embodiment is illustrative, and therefore should not be construed as being limiting in any way.

Turning now to FIG. 5B, a perspective view of the body side viewport retention sleeve 300 is illustrated. In FIG. 5B, the side that faces a user (e.g., the body side of the body side viewport retention sleeve 300) is shown. Visible in FIG. 5B are the body side flange 500, the aperture insertion portion 502, and the aperture insertion portion viewport aperture 506. It should be understood that this example embodiment is illustrative, and therefore should not be construed as being limiting in any way.

Figure 5C:
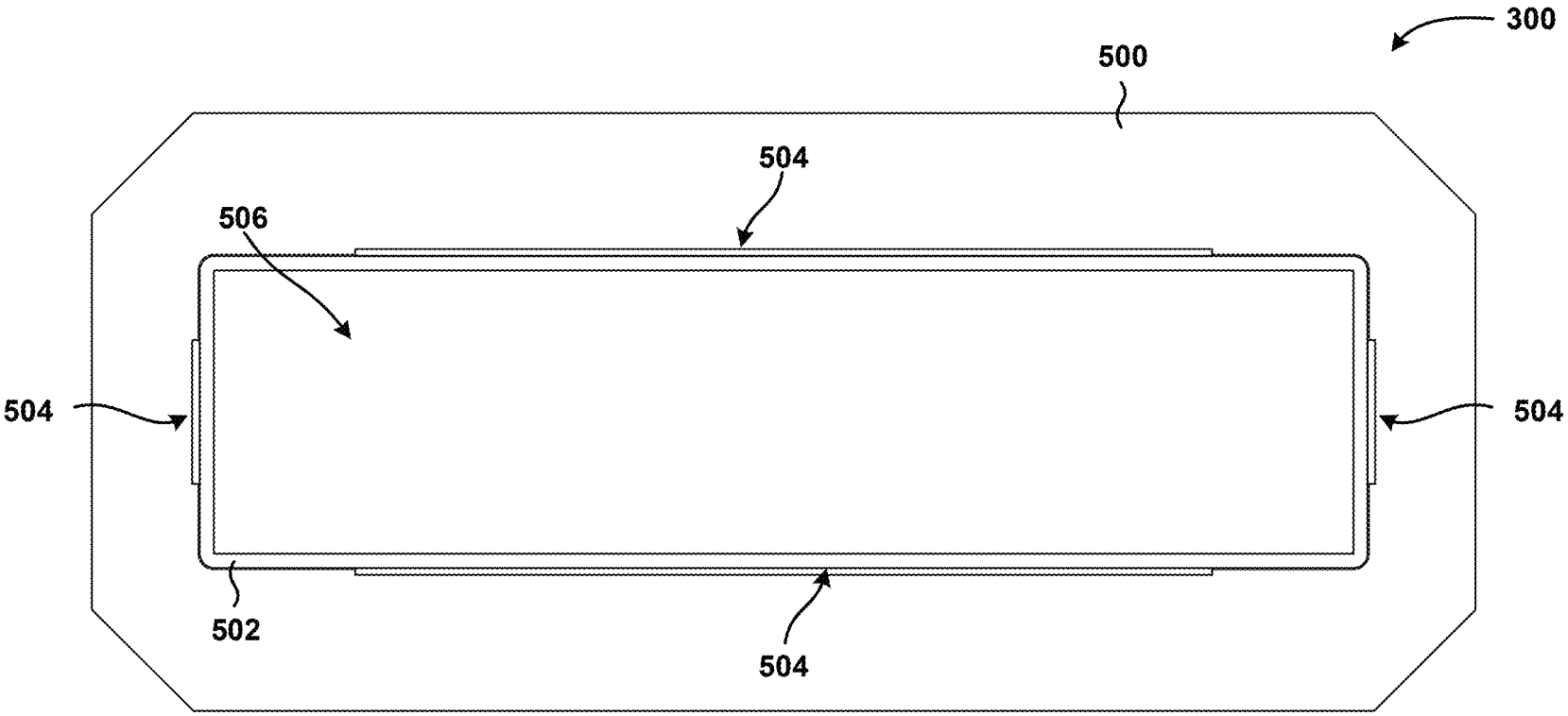
FIG. 5C is a line drawing illustrating a rear (body side) elevation view of the strike face side glass retention sleeve of a boltless viewport assembly, according to an illustrative embodiment of the concepts and technologies disclosed herein.

Turning now to FIG. 5C, a rear elevation view of the body side viewport retention sleeve 300 is illustrated. In FIG. 5C, the side of the body side viewport retention sleeve 300 that faces away from a user (e.g., the side that faces the body side 114 of the shield body 102, i.e., the strike face side of the body side viewport retention sleeve 300) is shown. Visible in FIG. 5C are the body side flange 500, the aperture insertion portion 502, the aperture insertion portion snap fit projections 504, and the aperture insertion portion viewport aperture 506. Thus, it can be appreciated with reference to FIG. 5C that the aperture insertion portion snap fit projections 504 can be configured to extend outwardly from a surface of the aperture insertion portion 502 in some embodiments. This is not necessarily the case in all embodiments, so it should be understood that this example embodiment is illustrative, and therefore should not be construed as being limiting in any way.

Figure 5D:
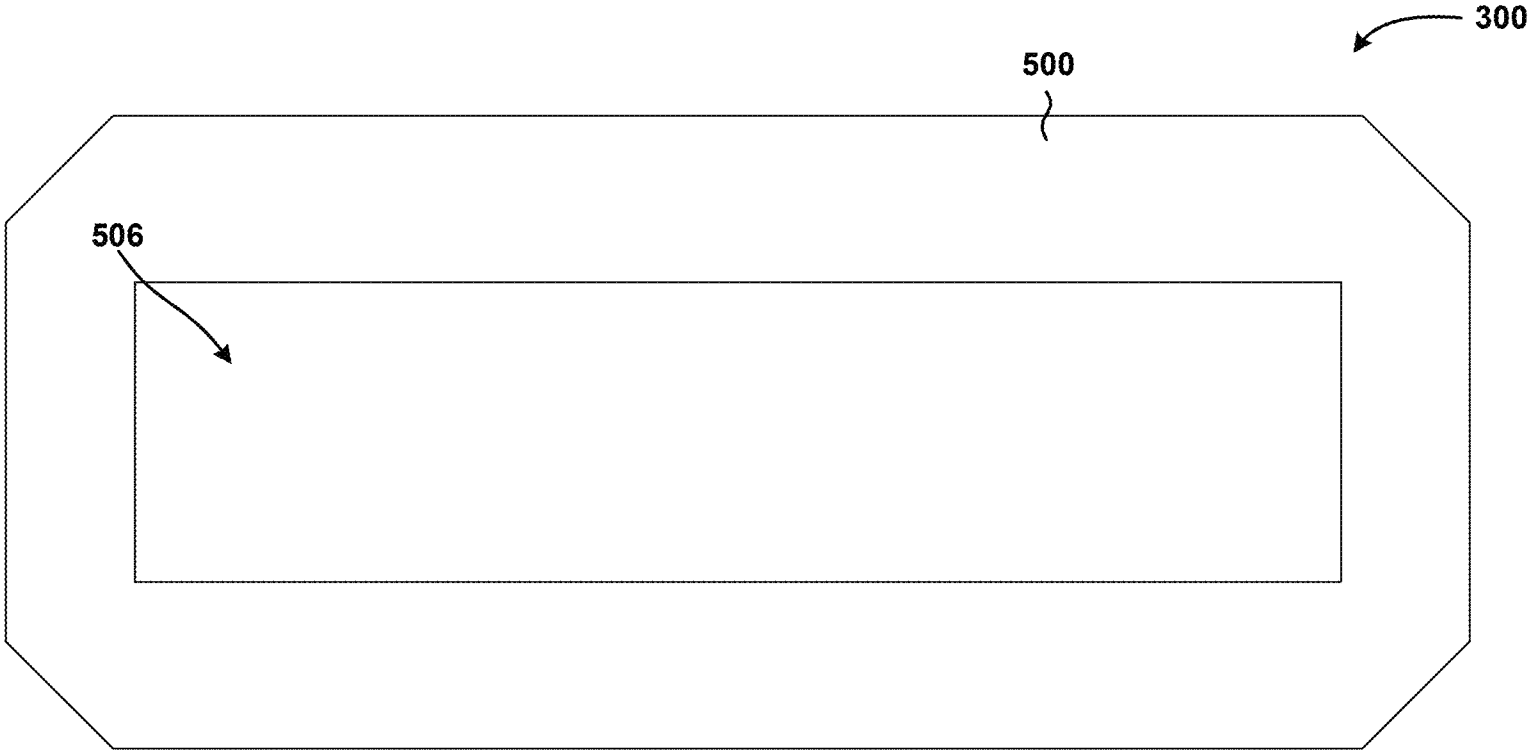
FIG. 5D is a line drawing illustrating a front (strike face side) elevation view of the strike face side glass retention sleeve of a boltless viewport assembly, according to an illustrative embodiment of the concepts and technologies disclosed herein.

Turning to FIG. 5D, a front elevation view of the body side viewport retention sleeve 300 is illustrated. In FIG. 5D, the body side of the body side viewport retention sleeve 300 (e.g., the side that faces the user, i.e., the body side) is shown. Visible in FIG. 5D are the body side flange 500 and the aperture insertion portion viewport aperture 506. It should be understood that this example embodiment is illustrative, and therefore should not be construed as being limiting in any way.

Figure 5E:
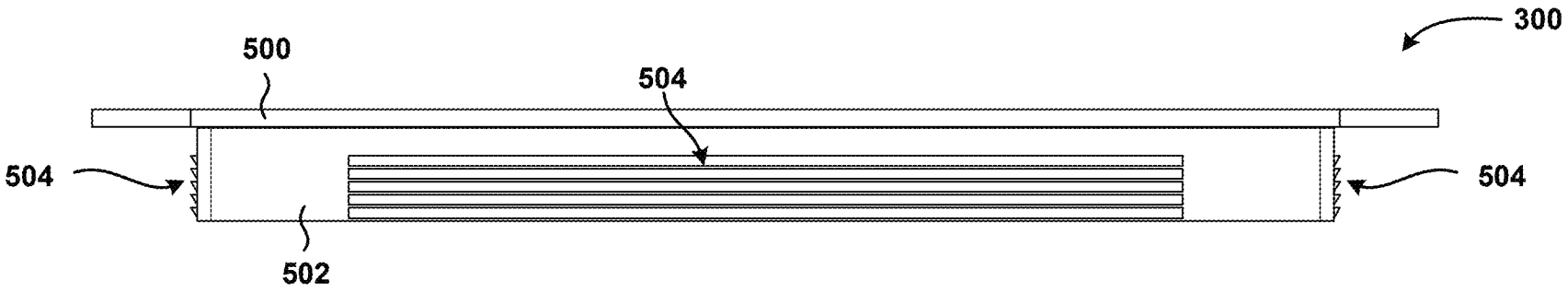
FIG. 5E is a line drawing illustrating a top view of the strike face side glass retention sleeve of a boltless viewport assembly, according to an illustrative embodiment of the concepts and technologies disclosed herein, the bottom view being substantially similar thereto.

Turning to FIG. 5E, a top elevation view of the body side viewport retention sleeve 300 is illustrated. It should be understood that the bottom view of the body side viewport retention sleeve 300 can be a mirror image of the top view shown in FIG. 5E and therefore the bottom view is not illustrated and described herein in detail. Visible in FIG. 5E are the body side flange 500, the aperture insertion portion 502, and the aperture insertion portion snap fit projections 504. Thus, it can be seen in FIG. 5E how the example aperture insertion portion snap fit projections 504 can be configured to extend outwardly from a surface of the aperture insertion portion 502 in all directions. This is not necessarily the case in all embodiments, so it should be understood that this example embodiment is illustrative, and therefore should not be construed as being limiting in any way.

Figure 5F:
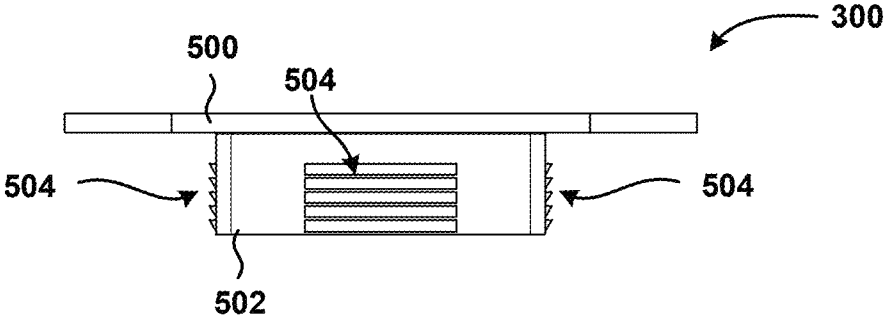
FIG. 5F is a line drawing illustrating a side elevation view of the strike face side glass retention sleeve of a boltless viewport assembly, according to an illustrative embodiment of the concepts and technologies disclosed herein, the second side view being a mirror image thereof.

As shown in FIG. 5F, a side elevation view of the body side viewport retention sleeve 300 is illustrated. It should be understood that the other side view of the body side viewport retention sleeve 300 can be a mirror image of the side view shown in FIG. 5F and therefore the other side view is not illustrated and described herein in detail. Visible in FIG. 5F are the body side flange 500, the aperture insertion portion 502, and the aperture insertion portion snap fit projections 504. Thus, it can be seen in FIG. 5F how the example aperture insertion portion snap fit projections 504 can be configured to extend outwardly from a surface of the aperture insertion portion 502 in all directions. This is not necessarily the case in all embodiments, so it should be understood that this example embodiment is illustrative, and therefore should not be construed as being limiting in any way.

Figure 6B:
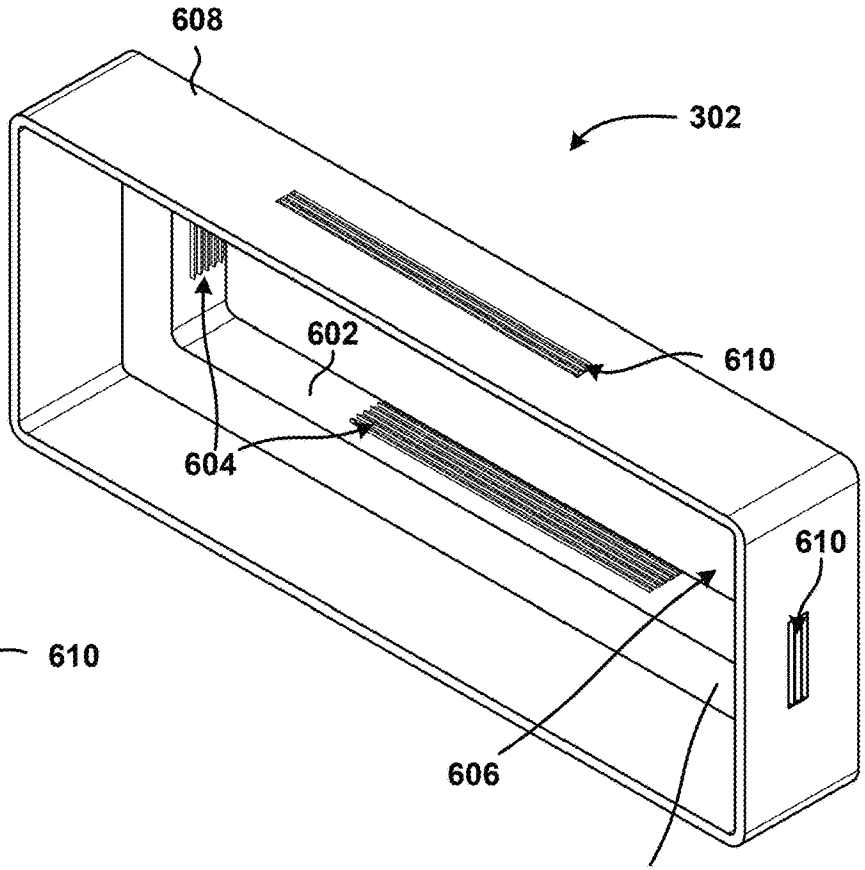
FIG. 6B is a line drawing illustrating a perspective view of the ballistic glass holder sleeve of a boltless viewport assembly as viewed from the strike face side, according to an illustrative embodiment of the concepts and technologies disclosed herein.
Figure 6A:
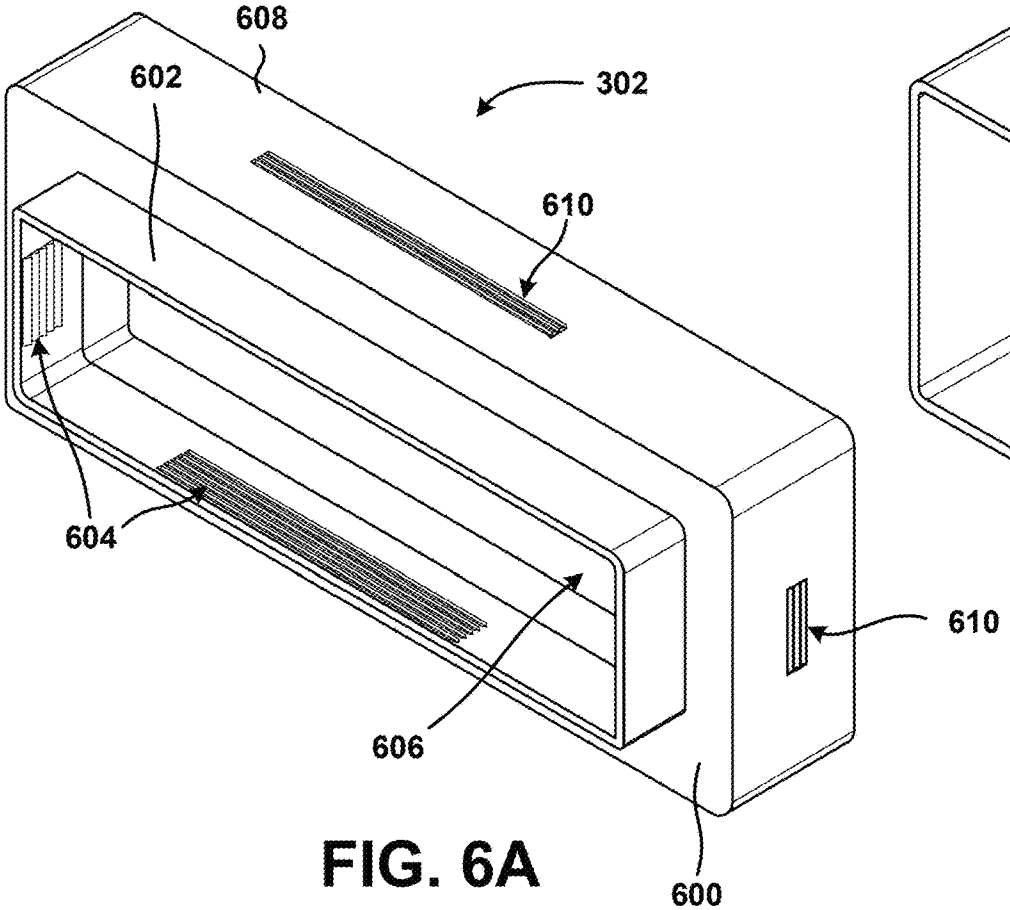
FIG. 6A is a line drawing illustrating a perspective view of the ballistic glass holder sleeve of a boltless viewport assembly as viewed from the body side, according to an illustrative embodiment of the concepts and technologies disclosed herein.

Turning now to FIGS. 6A-6F, the ballistic glass holder sleeve 302 will be illustrated and described in detail. In particular, FIG. 6A is a perspective view of the ballistic glass holder sleeve 302 from the side that contacts the shield body 102 (e.g., the body side of the ballistic glass holder sleeve 302). As can be seen in FIG. 6A, the ballistic glass holder sleeve 302 can include a strike face side support flange 600. According to various embodiments, as will be more clearly understood after illustrating and describing the various components of the boltless viewport assembly 104 in detail, the strike face side support flange 600 can contact a portion of the strike side face of the shield body 102 to create a support footprint for the ballistic glass holder sleeve 302 and the ballistic glass 106 when nested therein. Thus, the strike face side support flange 600 can be configured to extend over and overlap a portion of the shield body 102 on all four sides of the ballistic glass holder sleeve 302 in various embodiments. It should be understood that this example embodiment is illustrative, and therefore should not be construed as being limiting in any way.

It can be appreciated with reference to FIG. 6A that the strike face side support flange 600 can have a decorative or ornamental shape, though this is not necessarily the case in all embodiments. Because other shapes and/or dimensions for the strike face side support flange 600 are possible and are contemplated, it should be understood that this embodiment is illustrative and should not be construed as being limiting in any way. The ballistic glass holder sleeve 302 also can include an aperture sleeve portion 602. The aperture sleeve portion 602 can have various shapes, configurations, and/or dimensions and can be configured to create a sleeve inside the viewport aperture 306 of the shield body 102 in some embodiments. In the illustrated embodiment, the aperture sleeve portion 602 can have a substantially rectangularly-shaped configuration, which can be configured for insertion into and/or through the viewport aperture 306 of the shield body 102. It should be understood that this example embodiment is illustrative, and therefore should not be construed as being limiting in any way.

The aperture sleeve portion 602 can include one or more aperture sleeve portion snap fit projections 604 on one or more sides of the aperture sleeve portion 602. In the illustrated embodiment, each of four sides of the aperture sleeve portion 602 has one or more aperture sleeve portion snap fit projections 604, which can extend along approximately two thirds of the length of the respective sides. It should be understood that this example embodiment is illustrative, and therefore should not be construed as being limiting in any way. According to various embodiments of the concepts and technologies disclosed herein, the aperture sleeve portion snap fit projections 604 can be included on the two sides of the aperture sleeve portion 602 that are not visible in FIG. 6A. It should be understood that this example embodiment is illustrative, and therefore should not be construed as being limiting in any way.

According to various embodiments of the concepts and technologies disclosed herein, the aperture sleeve portion snap fit projections 604 can be configured to interact with the aperture insertion portion snap fit projections 504 to join the body side viewport retention sleeve 300 to the ballistic glass holder sleeve 302. In some embodiments, the aperture sleeve portion snap fit projections 604 and the aperture insertion portion snap fit projections 504 can nest together to create a permanent bond between these two components without necessarily requiring adhesives or other types of connection mechanisms (e.g., permanent in that disassembly of the two bonded components may destroy one or both components).

It should be understood that this example embodiment is illustrative, and therefore should not be construed as being limiting in any way.

The aperture sleeve portion 602 also can include an aperture sleeve portion viewport aperture 606, which can be dimensioned and/or configured in various manners. In the illustrated embodiment, the aperture sleeve portion viewport aperture 606 can be configured and/or dimensioned to be approximately equal in size and dimensions as the viewport aperture 306 of the shield body 102 and/or the aperture insertion portion viewport aperture 506. Thus, it can be appreciated that the aperture sleeve portion viewport aperture 606, the aperture insertion portion viewport aperture 506, and the viewport aperture 306 can cooperate to enable a user and/or other entity to look through the body side viewport retention sleeve 300, the ballistic glass holder sleeve 302, and the viewport aperture 306 of the shield body 102. It should be understood that this example embodiment is illustrative, and therefore should not be construed as being limiting in any way.

The ballistic glass holder sleeve 302 also can include a ballistic glass nest portion 608. The ballistic glass nest portion 608 can be configured to house and/or retain the ballistic glass 106 and therefore can be dimensioned and/or configured substantially similarly to the ballistic glass in some embodiments. It should be understood that this example embodiment is illustrative, and therefore should not be construed as being limiting in any way.

According to various embodiments of the concepts and technologies disclosed herein, the ballistic glass nest portion 608 can also include one or more ballistic glass nest portion grooves 610 on one or more sides of the ballistic glass nest portion 608. In the illustrated embodiment, each of four sides of the ballistic glass nest portion 608 can have one or more ballistic glass nest portion grooves 610. It should be understood that this example embodiment is illustrative, and therefore should not be construed as being limiting in any way. According to various embodiments of the concepts and technologies disclosed herein, the ballistic glass nest portion grooves 610 can be included on the two sides of the ballistic glass nest portion 608 that are not visible in FIG. 6A. It should be understood that this example embodiment is illustrative, and therefore should not be construed as being limiting in any way.

Turning now to FIG. 6B, a perspective view of the ballistic glass holder sleeve 302 is illustrated. In FIG. 6B, the side that faces away from the strike face side 116 of the shield body 102 (e.g., the strike face side of the ballistic glass holder sleeve 302) is shown. Visible in FIG. 6B are the strike face side support flange 600, the aperture sleeve portion 602, the aperture sleeve portion snap fit projections 604, the aperture sleeve portion viewport aperture 606, the ballistic glass nest portion 608, and the ballistic glass nest portion grooves 610. It will be appreciated that the strike face side support flange 600 also can support the ballistic glass 106, as illustrated and described herein. It should be understood that this example embodiment is illustrative, and therefore should not be construed as being limiting in any way.

Figure 6C:
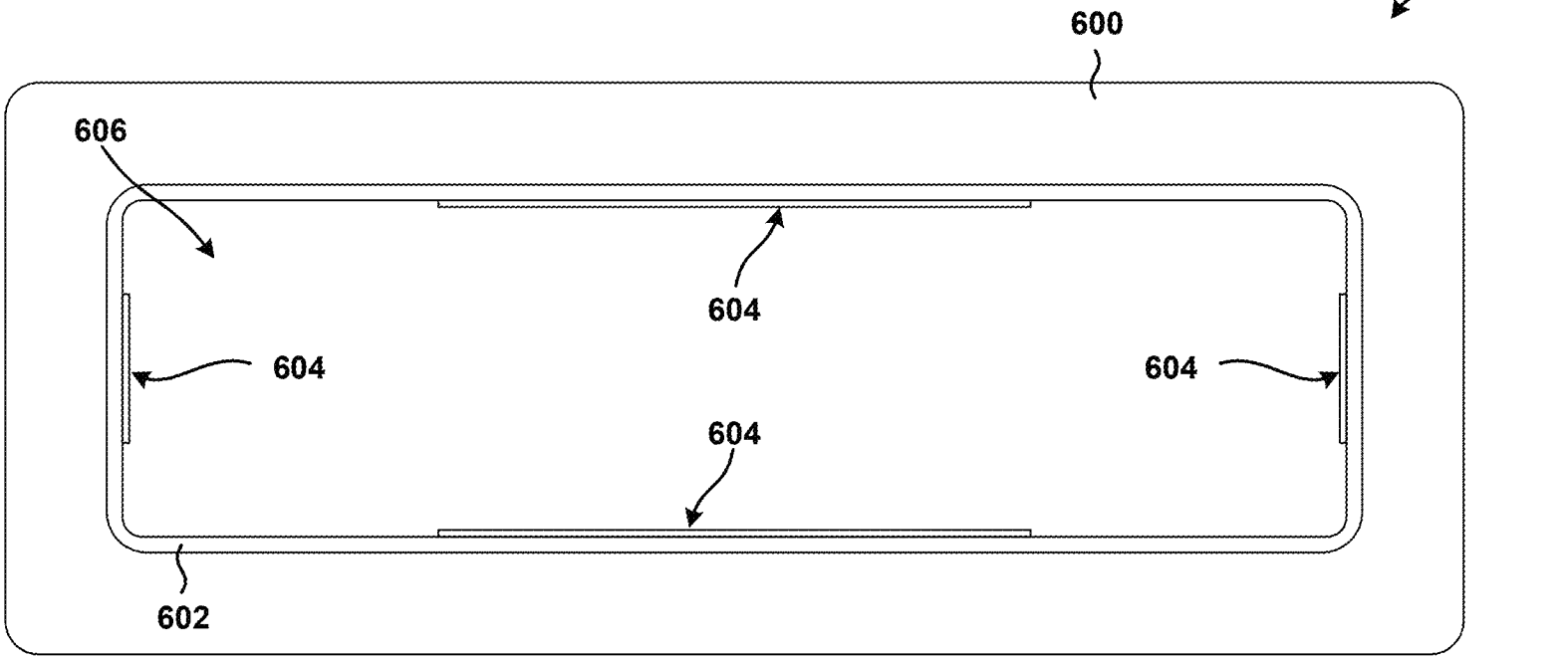
FIG. 6C is a line drawing illustrating a rear (body side) elevation view of the ballistic glass holder sleeve of a boltless viewport assembly, according to an illustrative embodiment of the concepts and technologies disclosed herein.

Turning now to FIG. 6C, a rear elevation view of the ballistic glass holder sleeve 302 is illustrated. In FIG. 6C, the side of the ballistic glass holder sleeve 302 that faces toward the user (e.g., the side that faces the strike face side 116 of the shield body 102, i.e., the body face side of the ballistic glass holder sleeve 302) is shown. Visible in FIG. 6C are the strike face side support flange 600, the aperture sleeve portion 602, the aperture sleeve portion snap fit projections 604, and the aperture sleeve portion viewport aperture 606. Thus, it can be appreciated with reference to FIG. 6C that the aperture sleeve portion snap fit projections 604 can be configured to extend inwardly from a surface of the aperture sleeve portion 602 in some embodiments. This is not necessarily the case in all embodiments, so it should be understood that this example embodiment is illustrative, and therefore should not be construed as being limiting in any way.

Figure 6D:
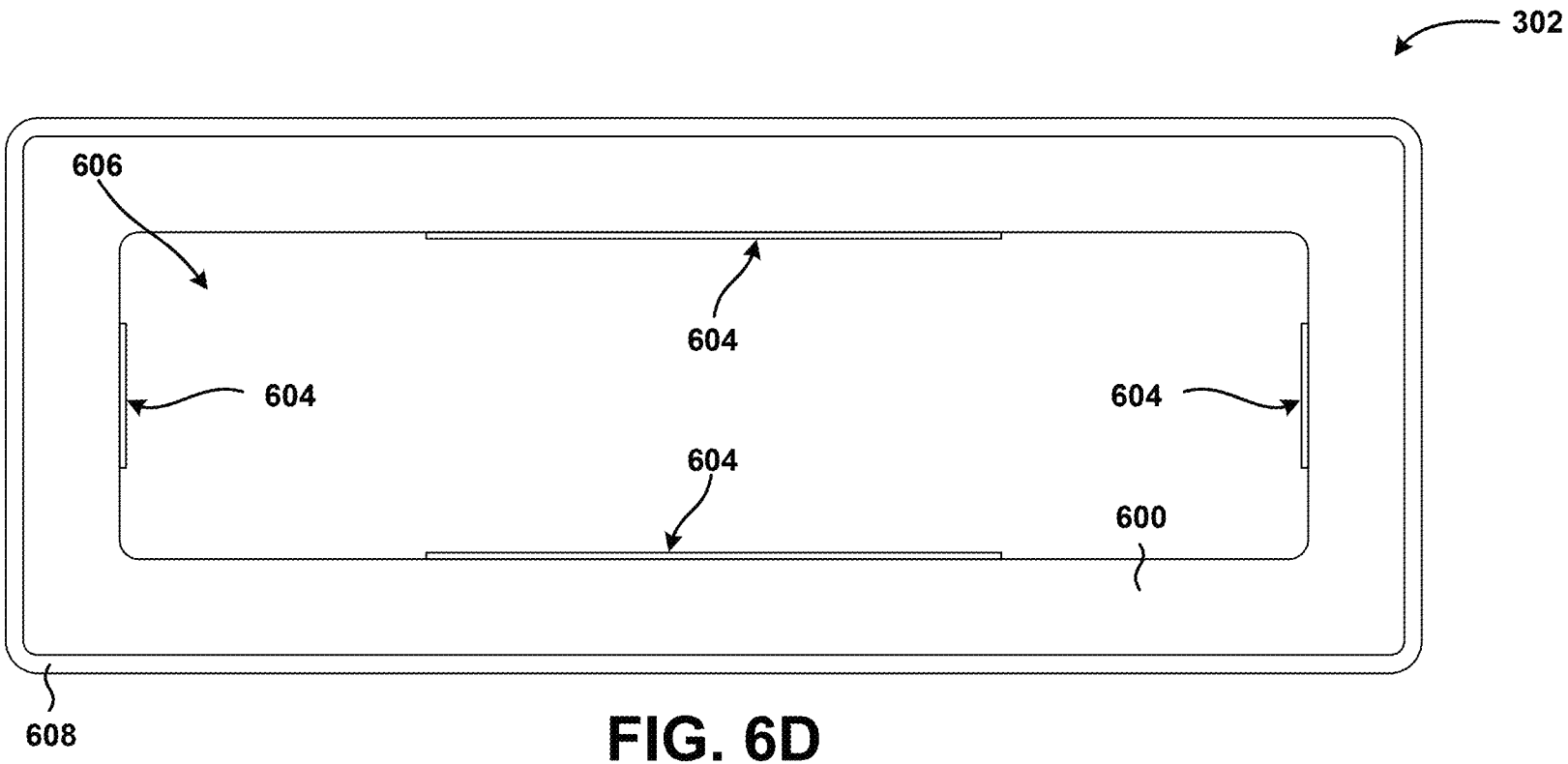
FIG. 6D is a line drawing illustrating a front (strike face side) elevation view of the ballistic glass holder sleeve of a boltless viewport assembly, according to an illustrative embodiment of the concepts and technologies disclosed herein.

Turning to FIG. 6D, a front elevation view of the ballistic glass holder sleeve 302 is illustrated. In FIG. 6D, the strike face side of the ballistic glass holder sleeve 302 (e.g., the side that faces away from the user and away from the shield body 102) is shown. Visible in FIG. 6D are the strike face side support flange 600, the aperture sleeve portion snap fit projections 604, the aperture sleeve portion viewport aperture 606, and the ballistic glass nest portion 608. It should be understood that this example embodiment is illustrative, and therefore should not be construed as being limiting in any way.

Figure 6E:
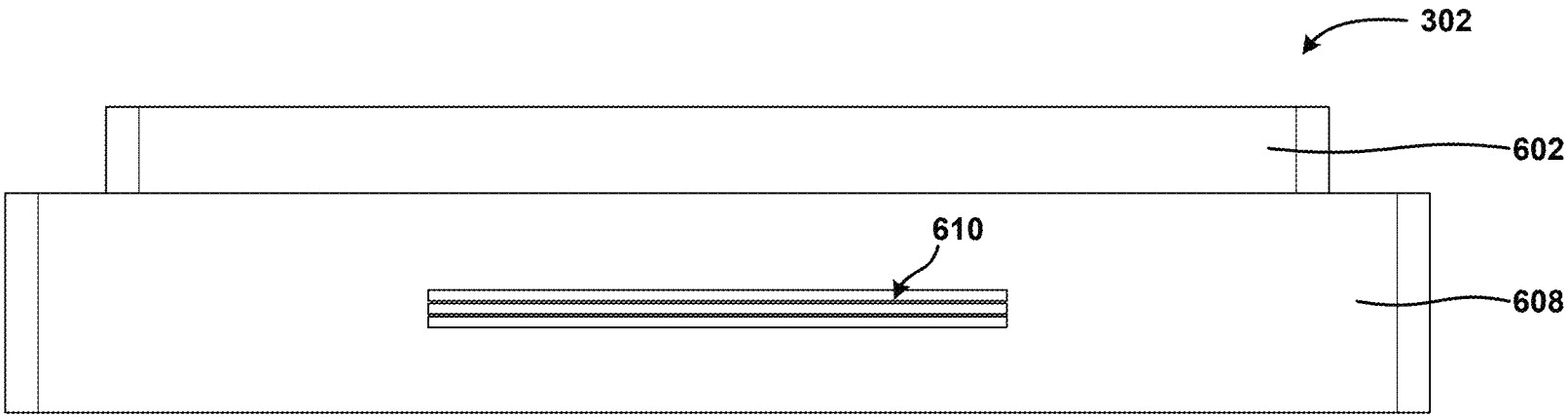
FIG. 6E is a line drawing illustrating a top view of the ballistic glass holder sleeve of a boltless viewport assembly, according to an illustrative embodiment of the concepts and technologies disclosed herein, the bottom view being substantially similar thereto.

Turning to FIG. 6E, a top elevation view of the ballistic glass holder sleeve 302 is illustrated. It should be understood that the bottom view of the ballistic glass holder sleeve 302 can be a mirror image of the top view shown in FIG. 6E and therefore the bottom view is not illustrated and described herein in detail. Visible in FIG. 6E are the aperture sleeve portion 602, the ballistic glass nest portion 608, and the ballistic glass nest portion grooves 610. It should be understood that this example embodiment is illustrative, and therefore should not be construed as being limiting in any way.

Figure 6F:
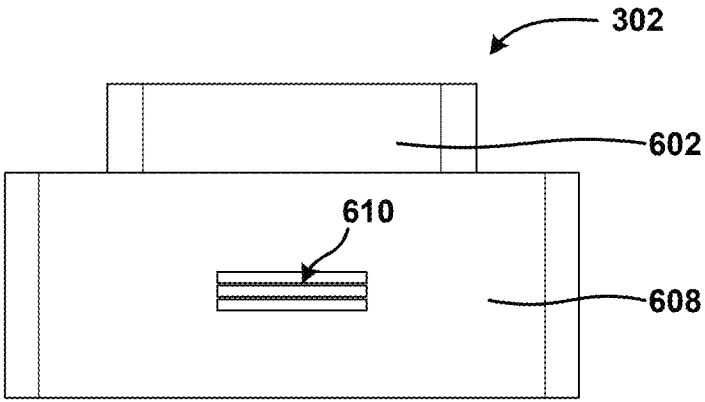
FIG. 6F is a line drawing illustrating a side elevation view of the ballistic glass holder sleeve of a boltless viewport assembly, according to an illustrative embodiment of the concepts and technologies disclosed herein, the second side view being a mirror image thereof.

As shown in FIG. 6F, a side elevation view of the ballistic glass holder sleeve 302 is illustrated. It should be understood that the other side view of the ballistic glass holder sleeve 302 can be a mirror image of the side view shown in FIG. 6F and therefore the other side view is not illustrated and described herein in detail. Visible in FIG. 6F are the aperture sleeve portion 602, the ballistic glass nest portion 608, and the ballistic glass nest portion grooves 610. It should be understood that this example embodiment is illustrative, and therefore should not be construed as being limiting in any way.

Figure 7B:
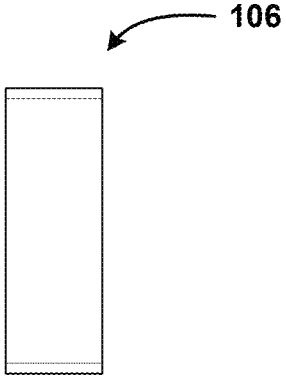
FIG. 7B is a line drawing illustrating a side view of the ballistic glass of a boltless viewport assembly, according to an illustrative embodiment of the concepts and technologies disclosed herein, the second side view being a mirror image thereof.
Figure 7A:
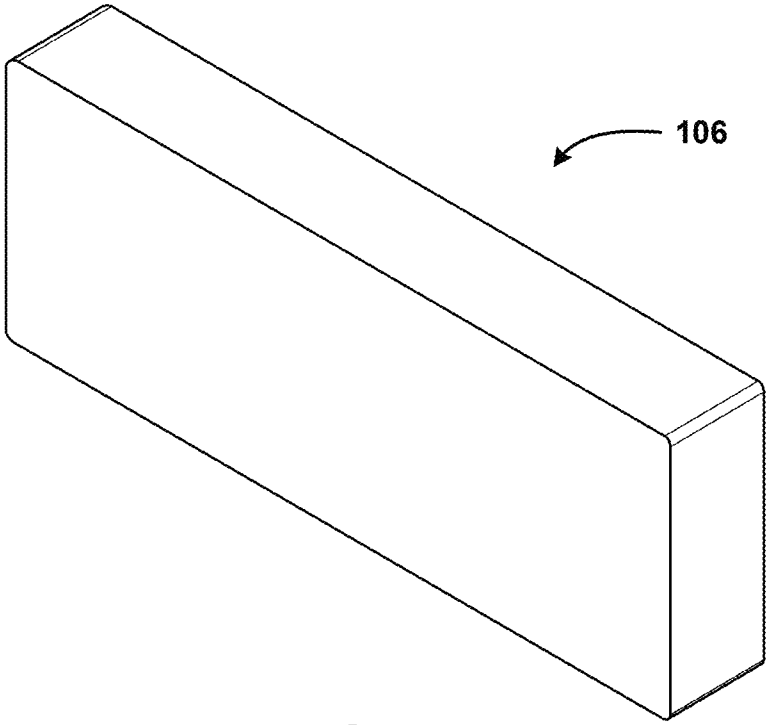
FIG. 7A is a line drawing illustrating a perspective view of the ballistic glass of a boltless viewport assembly as viewed from the body side, according to an illustrative embodiment of the concepts and technologies disclosed herein, the perspective view of the strike face side being substantially similar thereto.
Figure 7C:
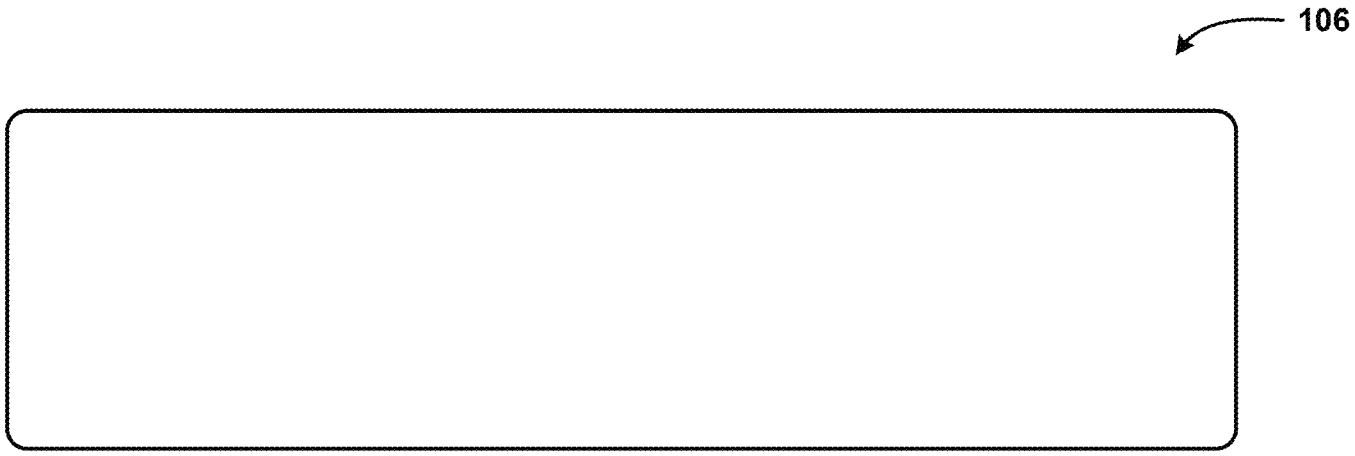
FIG. 7C is a line drawing illustrating a top view of the ballistic glass of a boltless viewport assembly, according to an illustrative embodiment of the concepts and technologies disclosed herein, the bottom view being substantially similar thereto.
Figure 7D:
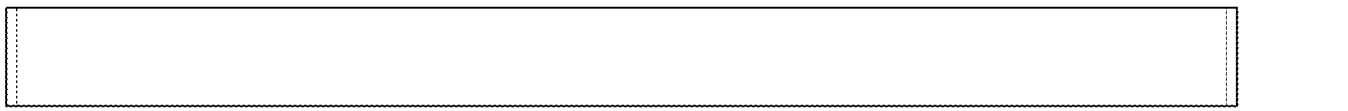
FIG. 7D is a line drawing illustrating a front (strike face side) elevation view of the ballistic glass of a boltless viewport assembly, according to an illustrative embodiment of the concepts and technologies disclosed herein, the rear (body side) view being substantially similar thereto.

Turning now to FIGS. 7A-7D, an example embodiment of the ballistic glass 106 is shown. FIG. 7A depicts a perspective view of the ballistic glass 106. FIG. 7B depicts a side view of the ballistic glass 106, the other side view being substantially similar to the illustrated view. FIG. 7C depicts a front elevation view of the ballistic glass 106, the rear view being substantially similar to the illustrated front view. FIG. 7D depicts a top elevation view of the ballistic glass 106, the bottom view being substantially similar to the illustrated top view.

It can be appreciated with reference to FIGS. 7A-7D that the configuration of the ballistic glass 106 can be substantially similar, in some embodiments, to the configuration of an interior of the ballistic glass nest portion 608. Thus, the ballistic glass 106 can be located inside the ballistic glass nest portion 608 to position and/or retain the ballistic glass 106 in a desired location relative to the boltless viewport assembly 104. Because the ballistic glass 106 can be configured and/or dimensioned in any desired manner, it should be understood that the illustrated example embodiment is illustrative, and therefore should not be construed as being limiting in any way.

Figure 8B:
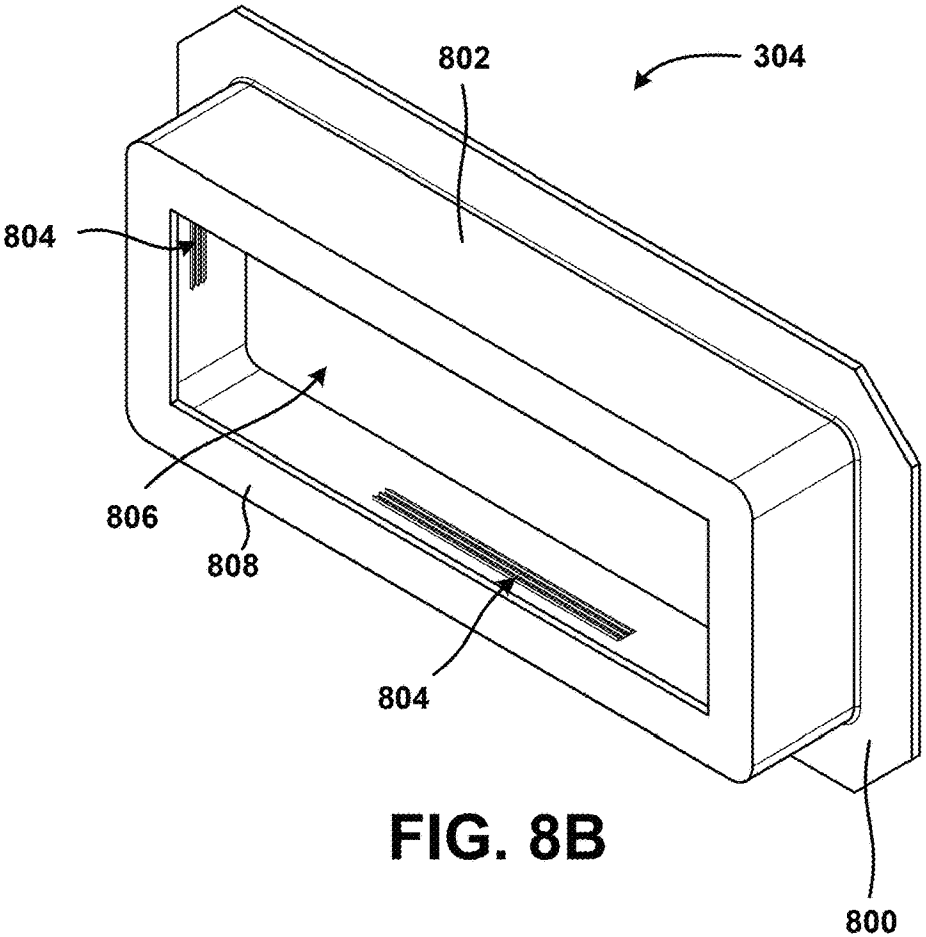
FIG. 8B is a line drawing illustrating a perspective view of the body side glass retention sleeve of a boltless viewport assembly as viewed from the strike face side, according to an illustrative embodiment of the concepts and technologies disclosed herein.
Figure 8A:
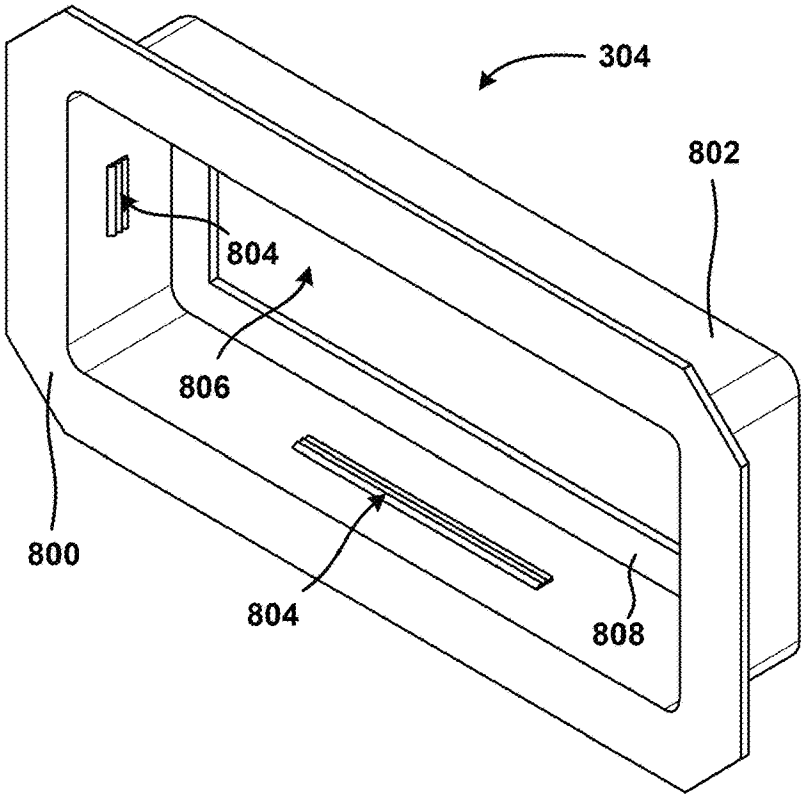
FIG. 8A is a line drawing illustrating a perspective view of the body side glass retention sleeve of a boltless viewport assembly as viewed from the body side, according to an illustrative embodiment of the concepts and technologies disclosed herein.

Turning now to FIGS. 8A-8F, the strike face side ballistic glass holder retention sleeve 304 will be illustrated and described in detail. In particular, FIG. 8A is a perspective view of the strike face side ballistic glass holder retention sleeve 304 from the side that contacts the shield body 102 (e.g., the strike face side of the strike face side ballistic glass holder retention sleeve 304). As can be seen in FIG. 8A, the strike face side ballistic glass holder retention sleeve 304 can include a strike face side flange 800. The strike face side flange 800 can be configured to extend over and overlap a portion of the shield body 102 on one or more of and/or on all four sides of the strike face side ballistic glass holder retention sleeve 304. It can be appreciated with reference to FIG. 8A that the strike face side flange 800 can have a decorative or ornamental shape, though this is not necessarily the case in all embodiments.

In the illustrated embodiment, the strike face side flange 800 is illustrated as having an irregular octagonal shape. In some embodiments, the shape and/or configuration of the strike face side flange 800 can be substantially similar to the shape and/or configuration of the body side flange 500 illustrated and described herein (e.g., wherein two of the sides have a first length, two of the sides have a second length, and four of the sides have a third length). It should be understood that this example embodiment is illustrative, and therefore should not be construed as being limiting in any way. In some embodiments, the irregular or stretched octagonal shape may be used in association with other octagonal elements (e.g., the bolts 200 and/or the decorative bolts 202 may include an octagonal shape in some embodiments). Because other shapes and/or dimensions for the strike face side flange 800 are possible and are contemplated, it should be understood that this embodiment is illustrative and should not be construed as being limiting in any way.

The strike face side ballistic glass holder retention sleeve 304 also can include a glass holder nesting portion 802. The glass holder nesting portion 802 can have various shapes, configurations, and/or dimensions. In the illustrated embodiment, the glass holder nesting portion 802 can have a substantially rectangularly-shaped configuration, which can be configured to approximately match outside dimensions and/or configurations of the ballistic glass holder sleeve 302. Thus, the ballistic glass holder sleeve 302 (with the ballistic glass 106 nested therein) can be inserted into the glass holder nesting portion 802 and/or the glass holder nesting portion 802 can be located over the ballistic glass holder sleeve 302. It should be understood that this example embodiment is illustrative, and therefore should not be construed as being limiting in any way.

The glass holder nesting portion 802 can also include one or more glass holder nesting portion snap fit projections 804 on one or more sides of the glass holder nesting portion 802. In the illustrated embodiment, each of four sides of the glass holder nesting portion 802 has one or more glass holder nesting portion snap fit projections 804. It should be understood that this example embodiment is illustrative, and therefore should not be construed as being limiting in any way. It should be appreciated that additional glass holder nesting portion snap fit projections 804 can be included on the two sides of the glass holder nesting portion 802 that are not visible in FIG. 8A in some embodiments. It should be understood that this example embodiment is illustrative, and therefore should not be construed as being limiting in any way.

The glass holder nesting portion 802 also can include a glass retention sleeve viewport aperture 806, which can be dimensioned and/or configured in various manners. In the illustrated embodiment, the glass retention sleeve viewport aperture 806 can be configured and/or dimensioned to be approximately equal in size and dimensions as the viewport aperture 306 of the shield body 102, the aperture sleeve portion viewport aperture 606 of the ballistic glass holder sleeve 302, and/or the aperture insertion portion viewport aperture 506 of the body side viewport retention sleeve 300. Thus, it can be appreciated that the glass retention sleeve viewport aperture 806, the aperture sleeve portion viewport aperture 606, the aperture insertion portion viewport aperture 506, and the viewport aperture 306 can cooperate to enable a user and/or other entity to look through the shield body 102 and all components of the boltless viewport assembly 104. It should be understood that this example embodiment is illustrative, and therefore should not be construed as being limiting in any way.

The strike face side ballistic glass holder retention sleeve 304 also can include a glass retention flange 808. The glass retention flange 808 can be configured to position and retain the ballistic glass 106 within the ballistic glass holder sleeve 302 in some embodiments. It should be understood that this example embodiment is illustrative, and therefore should not be construed as being limiting in any way.

Turning now to FIG. 8B, a perspective view of the strike face side ballistic glass holder retention sleeve 304 is illustrated. In FIG. 8B, the side that faces away from a user (e.g., the strike side of the strike face side ballistic glass holder retention sleeve 304) is shown. Visible in FIG. 8B are the strike face side flange 800, the glass holder nesting portion 802, the glass holder nesting portion snap fit projections 804, the glass retention sleeve viewport aperture 806, and the glass retention flange 808. It should be understood that this example embodiment is illustrative, and therefore should not be construed as being limiting in any way.

Figure 8C:
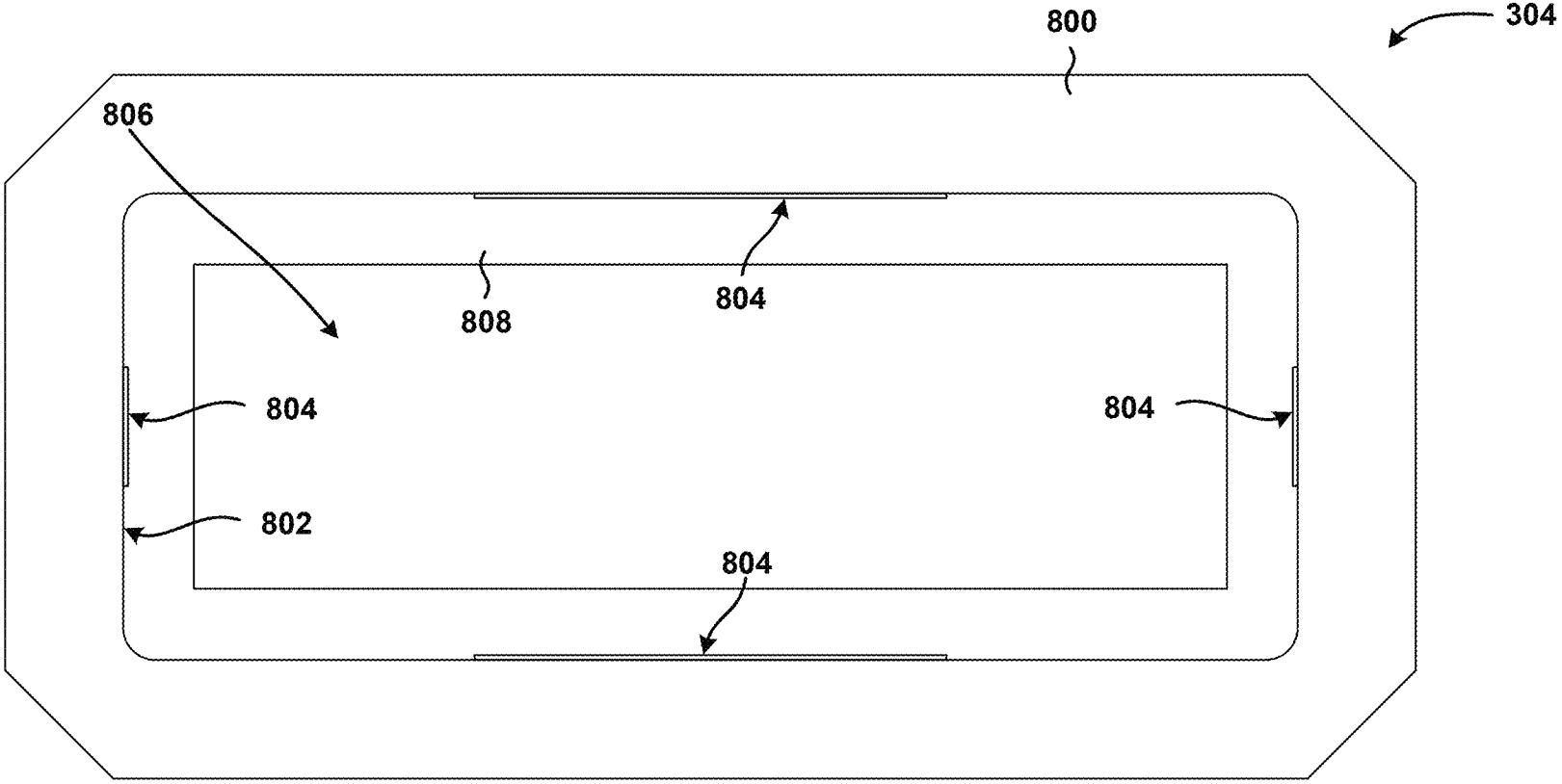
FIG. 8C is a line drawing illustrating a rear (body side) elevation view of the body side glass retention sleeve of a boltless viewport assembly, according to an illustrative embodiment of the concepts and technologies disclosed herein.

Turning now to FIG. 8C, a rear elevation view of the strike face side ballistic glass holder retention sleeve 304 is illustrated. In FIG. 8C, the side of the strike face side ballistic glass holder retention sleeve 304 that faces toward a user (e.g., the side that faces the strike face side 116 of the shield body 102) is shown. Visible in FIG. 8C are the strike face side flange 800, sidewalls of the glass holder nesting portion 802, the glass holder nesting portion snap fit projections 804, the glass retention sleeve viewport aperture 806, and the glass retention flange 808. It can be appreciated with reference to FIG. 8C that the glass holder nesting portion snap fit projections 804 can be configured to extend inwardly from the sidewalls of the glass holder nesting portion 802 in some embodiments. This is not necessarily the case in all embodiments, so it should be understood that this example embodiment is illustrative, and therefore should not be construed as being limiting in any way.

Figure 8D:
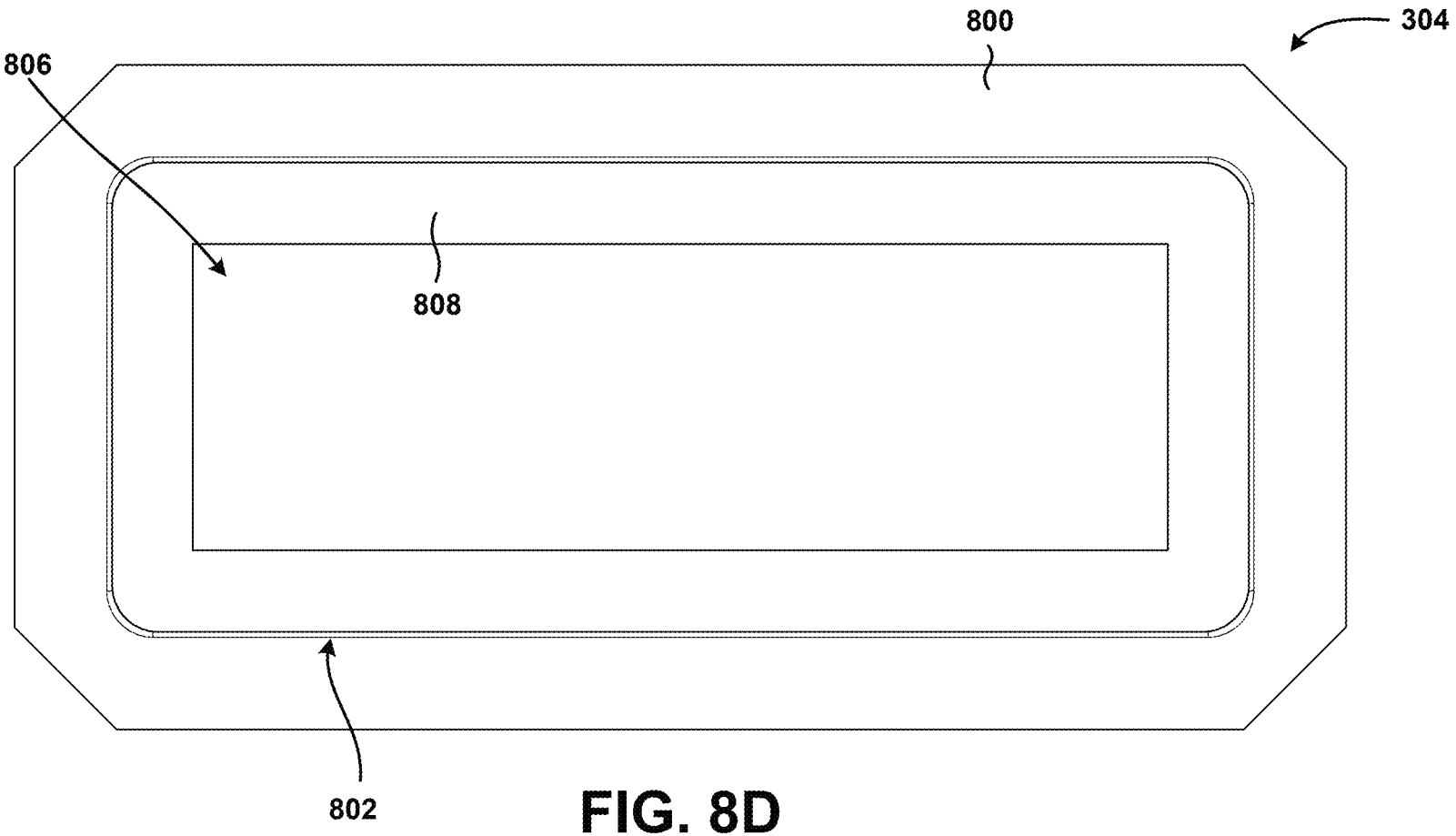
FIG. 8D is a line drawing illustrating a front (strike face side) elevation view of the body side glass retention sleeve of a boltless viewport assembly, according to an illustrative embodiment of the concepts and technologies disclosed herein.

Turning to FIG. 8D, a front elevation view of the strike face side ballistic glass holder retention sleeve 304 is illustrated. In FIG. 8D, the strike face side of the strike face side ballistic glass holder retention sleeve 304 (e.g., the side that faces away from the user and away from the shield body 102) is shown. Visible in FIG. 8D are the strike face side flange 800, sidewalls of the glass holder nesting portion 802, the glass retention sleeve viewport aperture 806, and the glass retention flange 808. It should be understood that this example embodiment is illustrative, and therefore should not be construed as being limiting in any way.

Figure 8E:
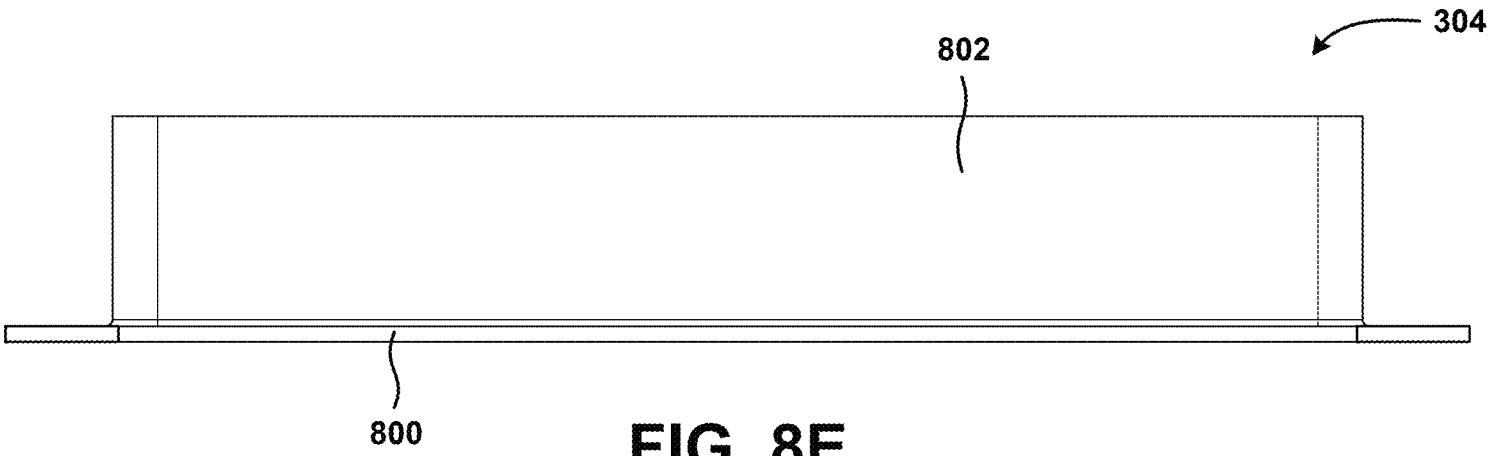
FIG. 8E is a line drawing illustrating a top view of the body side glass retention sleeve of a boltless viewport assembly, according to an illustrative embodiment of the concepts and technologies disclosed herein, the bottom view being substantially similar thereto.

Turning to FIG. 8E, a top elevation view of the strike face side ballistic glass holder retention sleeve 304 is illustrated. It should be understood that the bottom view of the strike face side ballistic glass holder retention sleeve 304 can be a mirror image of the top view shown in FIG. 8E and therefore the bottom view is not illustrated and described herein in detail. Visible in FIG. 8E are the strike face side flange 800 and the glass holder nesting portion 802. It should be understood that this example embodiment is illustrative, and therefore should not be construed as being limiting in any way.

Figure 8F:
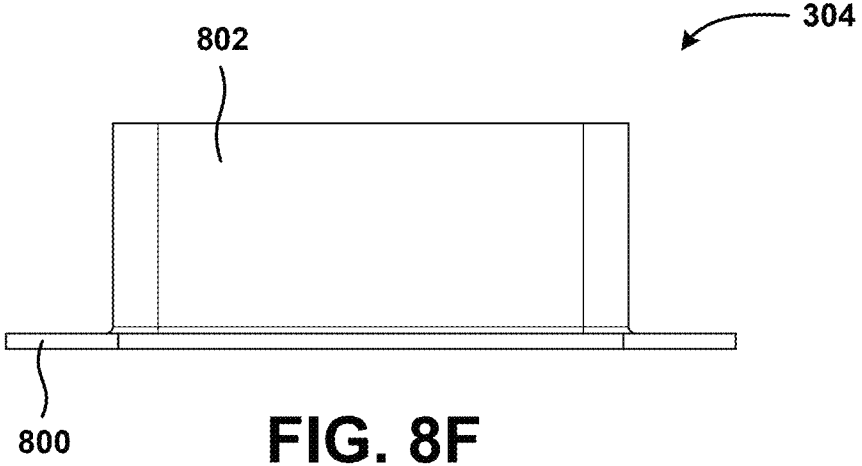
FIG. 8F is a line drawing illustrating a side elevation view of the body side glass retention sleeve of a boltless viewport assembly, according to an illustrative embodiment of the concepts and technologies disclosed herein, the second side view being a mirror image thereof.

As shown in FIG. 8F, a side elevation view of the strike face side ballistic glass holder retention sleeve 304 is illustrated. It should be understood that the other side view of the strike face side ballistic glass holder retention sleeve 304 can be a mirror image of the side view shown in FIG. 8F and therefore the other side view is not illustrated and described herein in detail. Visible in FIG. 8F are the strike face side flange 800 and the glass holder nesting portion 802. It should be understood that this example embodiment is illustrative, and therefore should not be construed as being limiting in any way.

Figure 9:
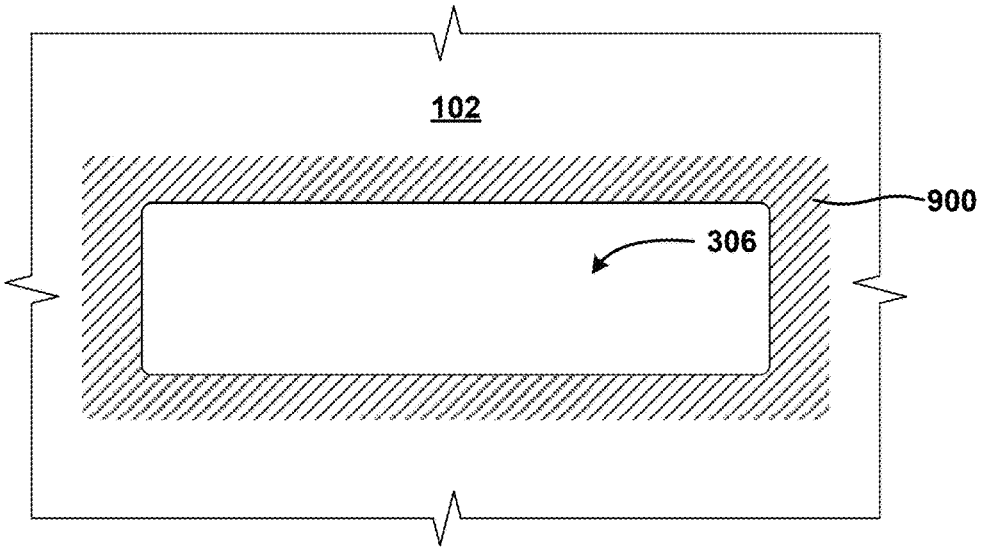
FIG. 9 is a line drawing illustrating a viewport aperture and ballistic glass support area of a shield body, according to an example embodiment of the concepts and technologies disclosed herein.

Turning now to FIG. 9, additional aspects of assembling the components of the boltless viewport assembly will be illustrated and described in detail. In particular, FIG. 9 shows a front (strike face side) elevation view of a portion of the shield body 102, wherein the portion shown in FIG. 9 includes the viewport aperture 306. As can be seen in FIG. 9, the shield body 102 also can include a ballistic glass support area 900. The ballistic glass support area 900 can include a portion of the shield body 102 that can support the ballistic glass 106 through the strike face side ballistic glass holder retention sleeve 304 when assembled to the shield body 102 as part of the boltless viewport assembly 104. Thus, it can be appreciated that the ballistic glass 106 can be reinforced by the shield body 102 in various embodiments of the concepts and technologies disclosed herein. It should be understood that this example embodiment is illustrative, and therefore should not be construed as being limiting in any way.

Turning now to FIGS. 10A-10E, the nesting and/or assembly of the components of the boltless viewport assembly 104 will be illustrated. An example order of operations is illustrated and described herein for illustration purposes, but it should be understood that the assembly of the components of the boltless viewport assembly 104 can occur in an alternative order in various embodiments. As such, the illustrated order is illustrative and should not be construed as being limiting in any way.

Figure 10A:
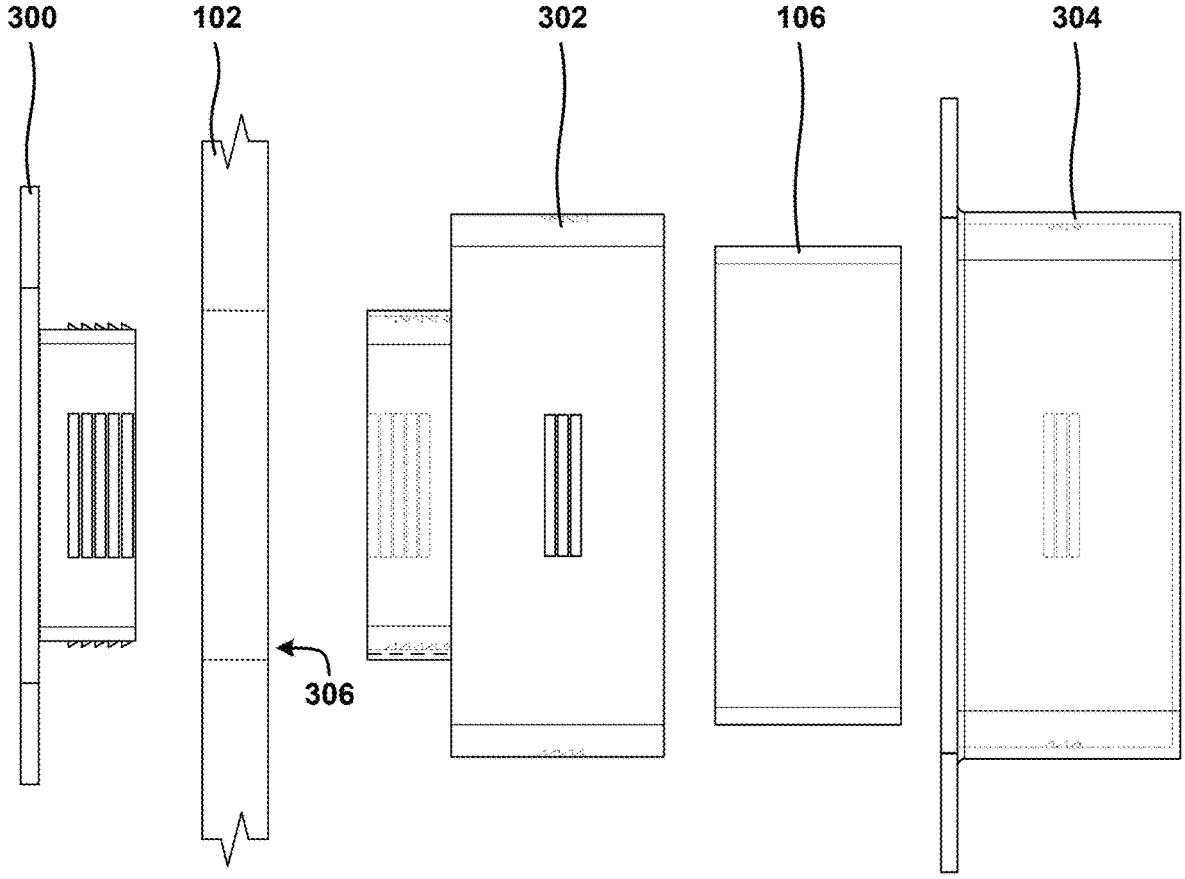
FIGS. 10A-10E are line drawings illustrating aspects of assembling the boltless viewport assembly, according to an example embodiment of the concepts and technologies disclosed herein.
Figure 10B:
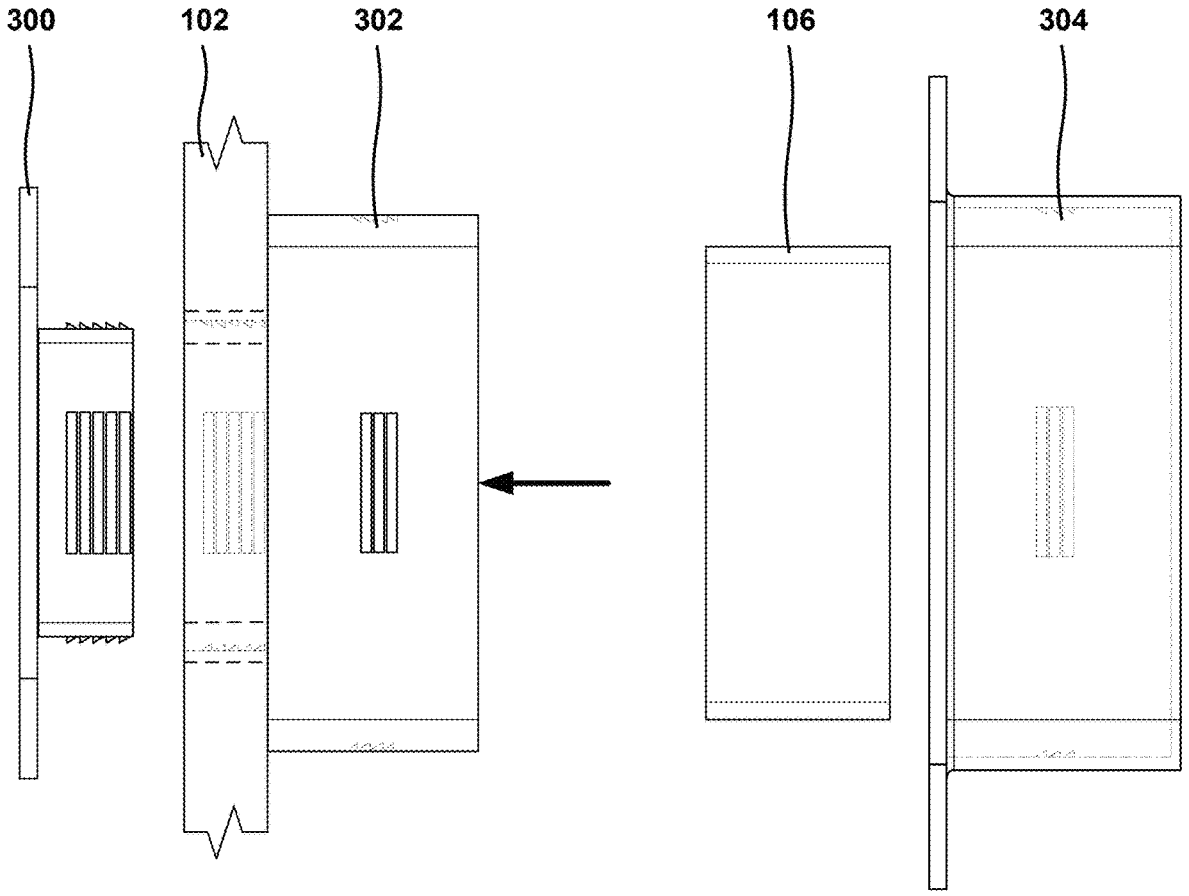

In FIG. 10A, the body side viewport retention sleeve 300, the shield body 102, the ballistic glass holder sleeve 302, the ballistic glass 106, and the strike face side ballistic glass holder retention sleeve 304 are illustrated in an example configuration that could exist prior to assembly of these components. It should be understood that this example embodiment is illustrative, and therefore should not be construed as being limiting in any way. As shown in FIG. 10B, a first operation for assembling the components of the boltless viewport assembly 104 together can include, in some embodiments, inserting the aperture sleeve portion 602 of the ballistic glass holder sleeve 302 through the viewport aperture 306 of the shield body 102.

Figure 10C:
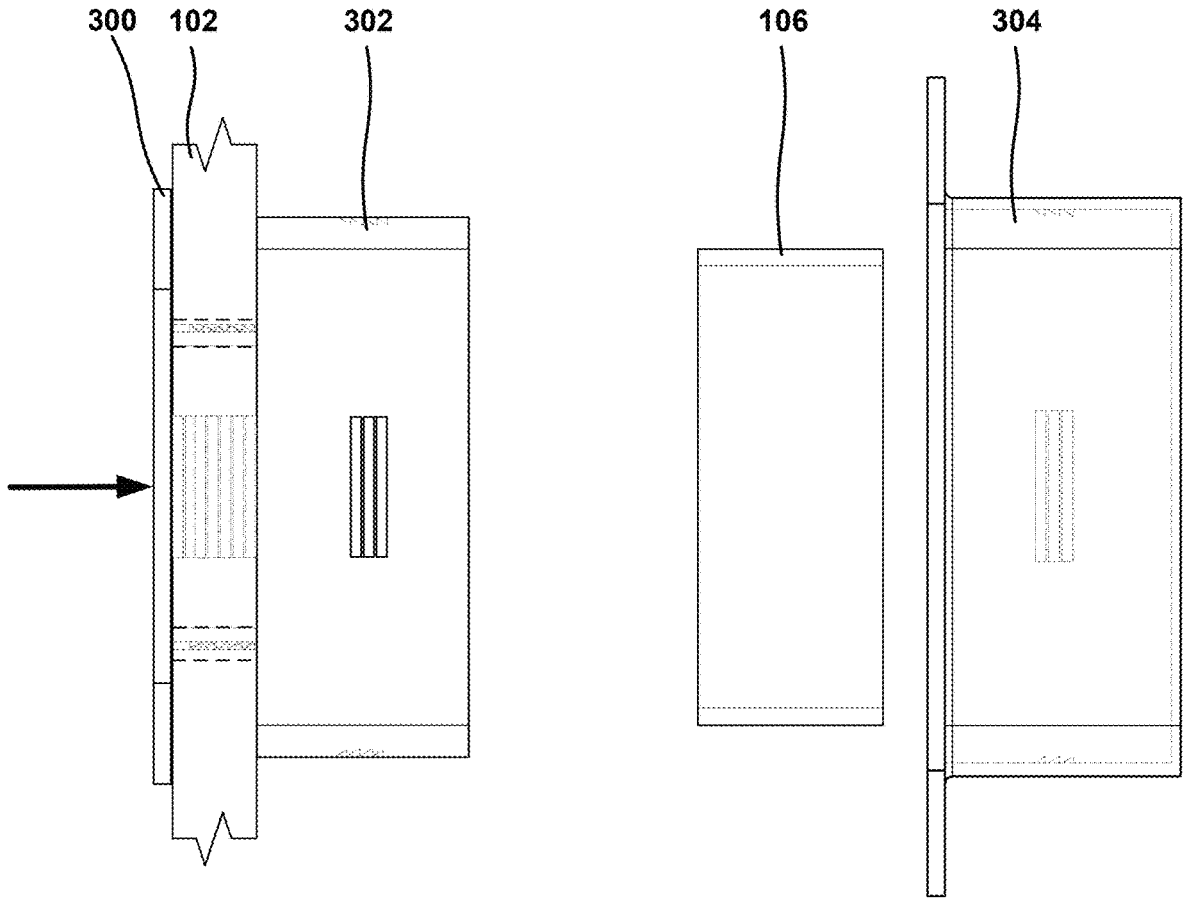

As shown in FIG. 10C, a third operation for assembling the components of the boltless viewport assembly 104 together can include inserting the body side viewport retention sleeve 300 through the viewport aperture 306 of the shield body 102 and into the ballistic glass holder sleeve 302. One or more of the aperture insertion portion snap fit projections 504 can engage one or more reciprocally located aperture sleeve portion snap fit projections 604, thereby locking the body side viewport retention sleeve 300 and ballistic glass holder sleeve 302 in place with the shield body 102 therebetween. It should be understood that this example embodiment is illustrative, and therefore should not be construed as being limiting in any way.

Figure 10D:
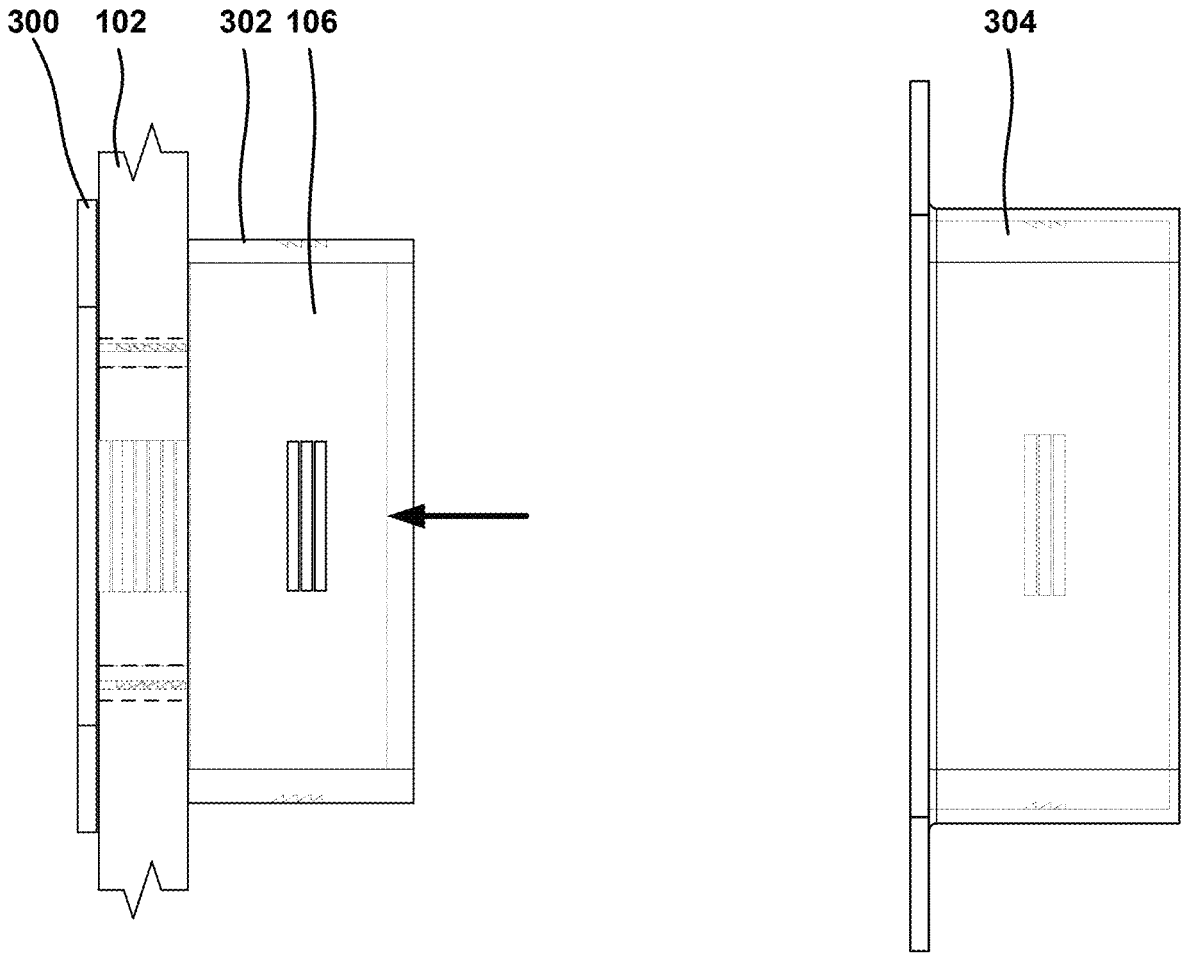
Figure 10E:
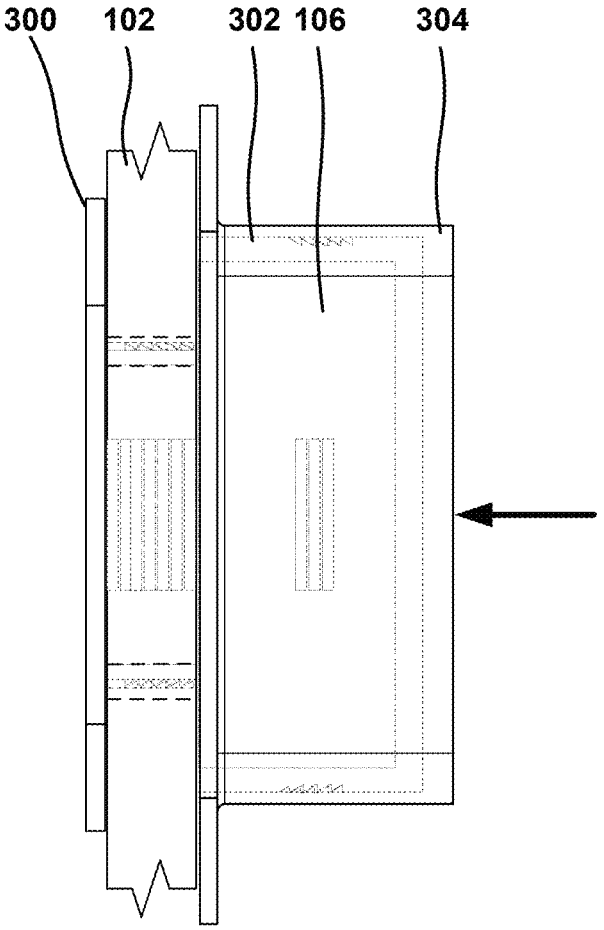
Figure 11A:
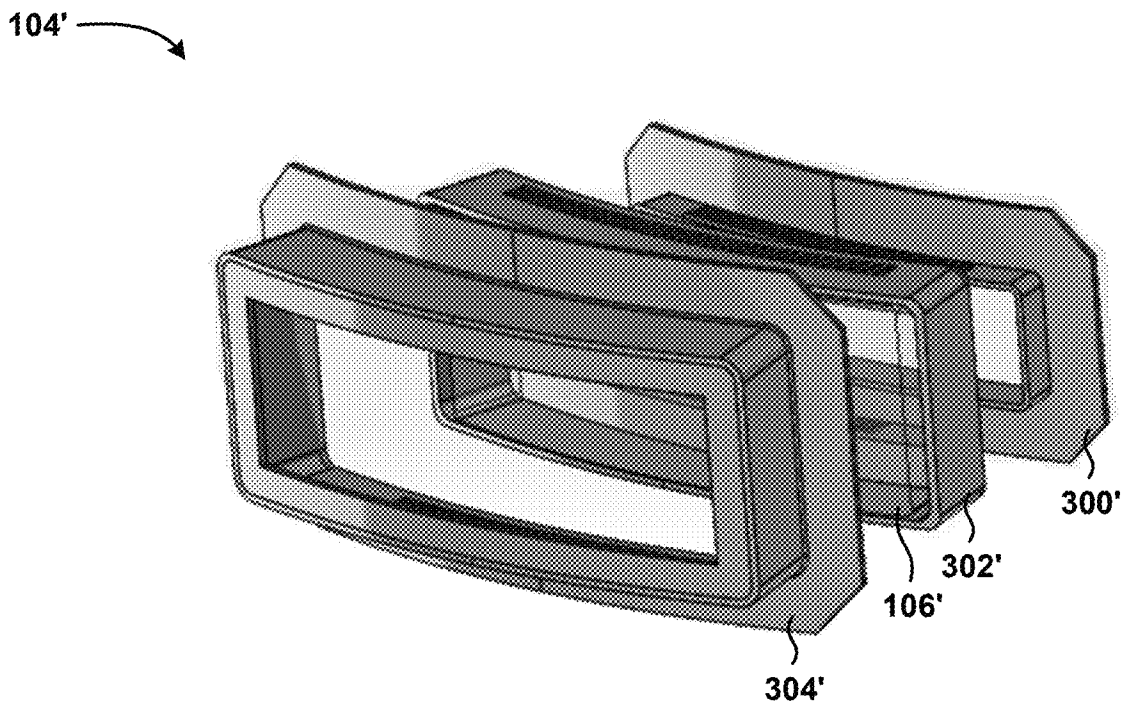
FIGS. 11A-11D illustrate a curved embodiment of the boltless viewport assembly, according to an example embodiment of the concepts and technologies disclosed herein.
Figure 11B:
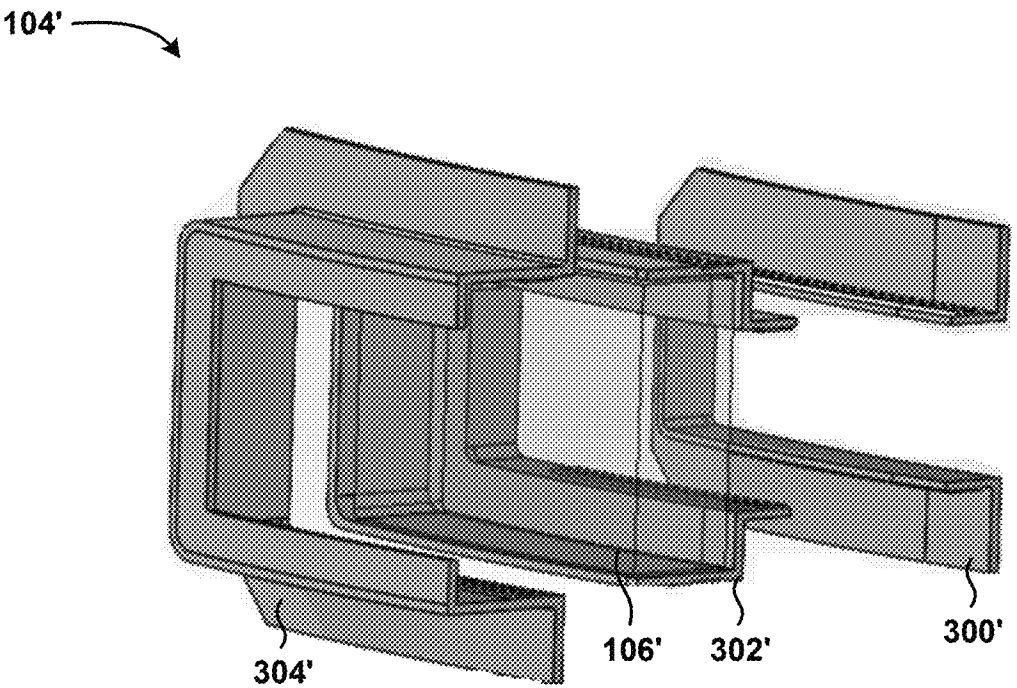
Figure 11C:
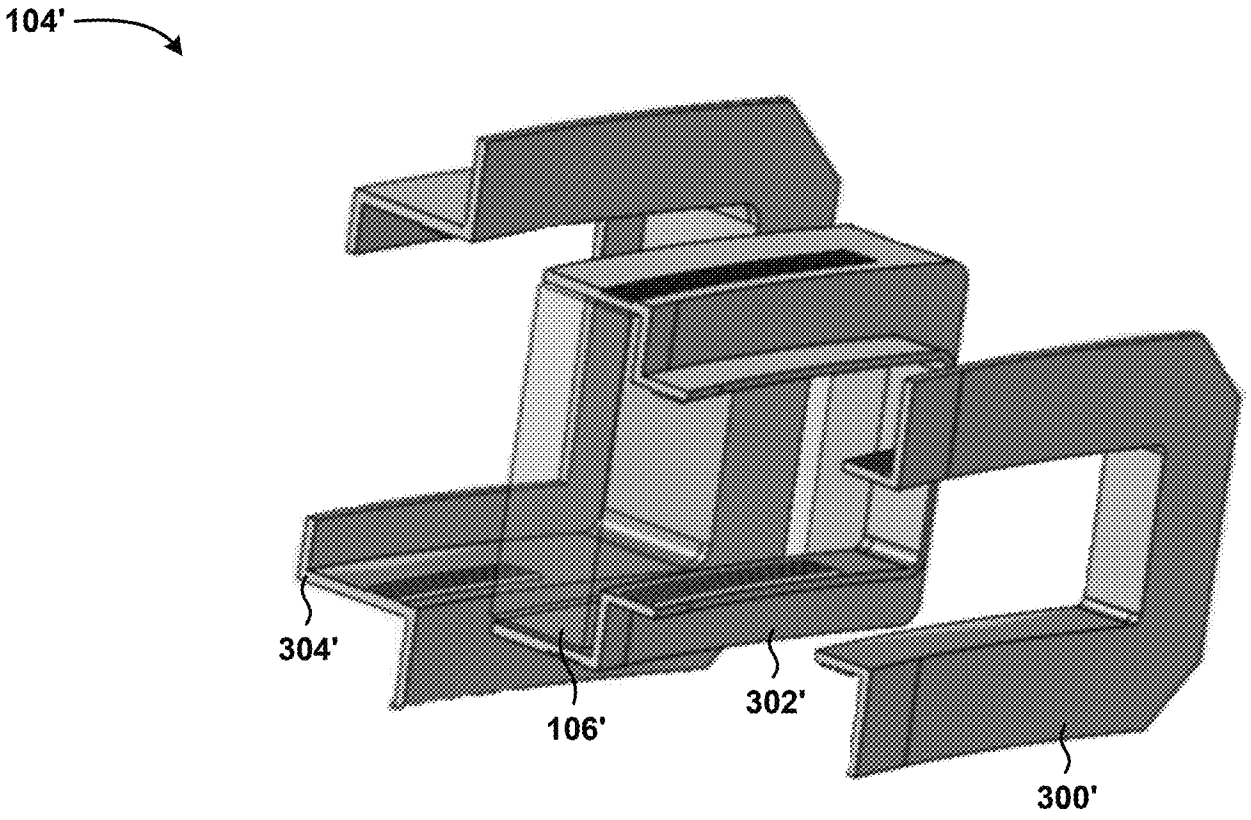
Figure 11D:
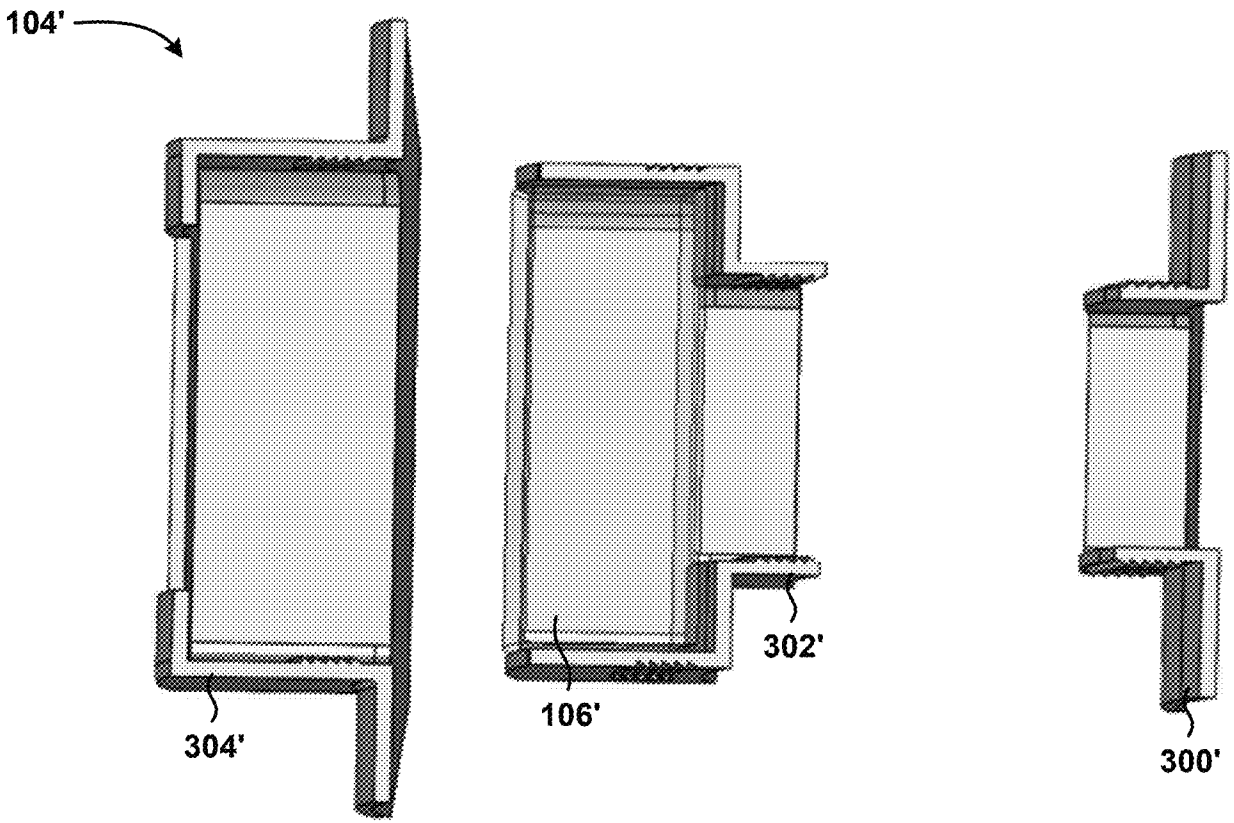

As shown in FIG. 10D, a fourth operation for assembling the components of the boltless viewport assembly 104 together can include inserting the ballistic glass 106 into the ballistic glass holder sleeve 302. As shown in FIG. 10E, a fifth operation for assembling the components of the boltless viewport assembly 104 together can include inserting the ballistic glass holder sleeve 302 into the strike face side ballistic glass holder retention sleeve 304 by engaging one or more of the glass holder nesting portion snap fit projections 804 to one or more of the ballistic glass nest portion grooves 610, thereby locking the ballistic glass holder sleeve 302 to the strike face side ballistic glass holder retention sleeve 304 and in place with the shield body 102 therebetween.

While the figures and description thereof have illustrated and described a boltless viewport assembly 104 that includes four components, it should be understood that some embodiments of the boltless viewport assembly 104 can be formed from three components, or even two components. Namely, various embodiments of the concepts and technologies disclosed herein as illustrated and described herein include the body side viewport retention sleeve 300, the ballistic glass holder sleeve 302, the ballistic glass 106, and the strike face side ballistic glass holder retention sleeve 304, which can be assembled to the shield body 102. In some embodiments of the concepts and technologies disclosed herein, however, the boltless viewport assembly 104 can include the body side viewport retention sleeve 300, the ballistic glass 106, and an embodiment of the ballistic glass holder sleeve 302 that can include a retention flange or other structure to hold the ballistic glass in the ballistic glass holder sleeve 302, thereby obviating the strike face side ballistic glass holder retention sleeve 304 and/or incorporating some of the functionality and/or structure of the strike face side ballistic glass holder retention sleeve 304 into the ballistic glass holder sleeve 302.

Thus, for example, an embodiment of the boltless viewport assembly 104 as described herein can include an embodiment of the body side viewport retention sleeve 300 being inserted into and/or through the shield body 102 and mated with an embodiment of the ballistic glass holder sleeve 302, which can retain the ballistic glass 106 (e.g., the ballistic glass 106 can be inserted into the ballistic glass holder sleeve 302 via an opening in a side of the ballistic glass holder sleeve 302), where the ballistic glass holder sleeve 302 can include a flange on the strike face side (e.g., similar to the strike face side support flange 600) to retain the ballistic glass 106 therein and/or another flange for decorative or other purposes (e.g., similar to the strike face side flange 800). It should be understood that this example embodiment is illustrative, and therefore should not be construed as being limiting in any way. Alternatively, the ballistic glass holder sleeve can include detents, posts, ties, or other functionality for retaining the ballistic glass 106 therein in some embodiments without departing from the concepts and technologies disclosed herein. It should be understood that these example embodiments are illustrative, and therefore should not be construed as being limiting in any way.

It also should be understood that embodiments of the concepts and technologies disclosed herein can enable the retrofitting of a boltless viewport assembly 104 to other shields or other structures in addition to, or instead of, the ballistic shield 100 illustrated and described herein. Thus, for example, a shield that does not include a viewport can be modified to form therein a viewport aperture 306, and the boltless viewport assembly 104 can be assembled to the shield as illustrated and described herein. Thus, embodiments of the concepts and technologies disclosed herein can be used to retrofit shields with a boltless viewport assembly 104. It should be understood that this example embodiment is illustrative, and therefore should not be construed as being limiting in any way.

Turning now to FIGS. 11A-11D, another embodiment of the boltless viewport assembly 104' will be described, according to an example embodiment of the concepts and technologies disclosed herein. As can be seen in FIGS. 11A-11D, the boltless viewport assembly 104' can include a body side viewport retention sleeve 300', a ballistic glass holder sleeve 302', the ballistic glass 106', and a strike face side ballistic glass holder retention sleeve 304'. In the illustrated embodiment shown in FIGS. 11A-11D, the boltless viewport assembly 104' can be substantially similar to the boltless viewport assembly 104, though the boltless viewport assembly 104' can be partially curved and intended for attachment to a curved or partially curved shield body 102 (not visible in FIGS. 11A-11D). Thus, it can be appreciated that the shapes of body side viewport retention sleeve 300, 300', ballistic glass holder sleeve 302, 302', the ballistic glass 106, 106', and the strike face side ballistic glass holder retention sleeve 304, 304' can be modified in many manners without departing from the scope of the concepts and technologies disclosed herein.

While the above disclosure has illustrated the boltless viewport assemblies 104, 104' being attached to a shield body 102 to form a ballistic shield 100, it should be understood that various embodiments of the concepts and technologies disclosed herein can include attaching the boltless viewport assemblies 104, 104' to other structures such as walls, moveable or immovable barriers, car doors or walls, floors, aircraft walls, or other structures, or the like. Thus, embodiments of the concepts and technologies disclosed herein can be used to provide a viewport in and/or through structures other than a shield body 102 in various embodiments. Thus, embodiments of the concepts and technologies disclosed herein can provide a boltless viewport for almost any structure and therefore dimensions and/or configurations of the boltless viewport assemblies 104, 104' illustrated and described herein are illustrative of the structures and components of some embodiments of a boltless viewport and should not be construed as being limiting in any way.

Based on the foregoing, it can be appreciated that a boltless viewport assembly for a ballistic shield has been disclosed herein. Although the subject matter presented herein has been described with respect to various structural features and/or methodological and transformative acts for forming the boltless viewport assembly for a ballistic shield and/or the various features thereof, it is to be understood that the concepts and technologies disclosed herein are not necessarily limited to the specific features or acts described herein. Rather, the specific features and acts are disclosed as example forms of implementing the concepts and technologies disclosed herein.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

The invention claimed is:

1. A ballistic shield comprising a boltless viewport assembly, the ballistic shield comprising a shield body having a body side and a strike face side, the shield body having a viewport aperture formed therethrough, and the boltless viewport assembly comprising:

a piece of ballistic glass;

a body side viewport retention sleeve comprising a body side flange and an aperture insertion portion that is configured to be inserted into the viewport aperture from the body side of the shield body;

a ballistic glass holder sleeve comprising an aperture sleeve portion and a ballistic glass nest portion configured to receive the piece of ballistic glass, wherein the aperture sleeve portion is configured to be inserted into the viewport aperture from the strike face side of the shield body; and a strike face side ballistic glass holder retention sleeve comprising a strike face side flange.

2. The ballistic shield of claim 1, wherein the aperture insertion portion of the body side viewport retention sleeve comprises aperture insertion portion snap fit projections that are configured to mate with aperture sleeve portion snap fit projections formed on the ballistic glass holder sleeve to attach the body side viewport retention sleeve and the ballistic glass holder sleeve to the shield body.

3. The ballistic shield of claim 1, wherein the ballistic glass nest portion of the ballistic glass holder sleeve comprises ballistic glass nest portion grooves formed on an outer surface of the ballistic glass holder sleeve, wherein the ballistic glass nest portion grooves are configured to mate with glass holder nesting portion snap fit projections formed on an inside surface of the strike face side ballistic glass holder retention sleeve to attach the strike face side ballistic glass holder retention sleeve to the ballistic glass holder sleeve.

4. The ballistic shield of claim 1, wherein the body side flange is located on the body side of the shield body.

5. The ballistic shield of claim 1, wherein the strike face side flange is located on the strike face side of the shield body.

6. The ballistic shield of claim 1, wherein the ballistic glass holder sleeve comprises a strike side support flange, and wherein the strike side support flange is configured to support the piece of ballistic glass in cooperation with a ballistic glass support area of the shield body.

7. The ballistic shield of claim 1, wherein the boltless viewport assembly is assembled to the shield body without bolts, without welding, and without screws.

8. A ballistic shield comprising a boltless viewport assembly, the ballistic shield comprising a shield body having a body side and a strike face side, the shield body having a viewport aperture formed therethrough, and the boltless viewport assembly comprising:

a piece of ballistic glass;

a body side viewport retention sleeve comprising a body side flange and an aperture insertion portion that is configured to be inserted into the viewport aperture from the body side of the shield body;

a ballistic glass holder sleeve comprising an aperture sleeve portion and a ballistic glass nest portion configured to receive the piece of ballistic glass, wherein the aperture sleeve portion is configured to be inserted into the viewport aperture from the strike face side of the shield body; and a strike face side ballistic glass holder retention sleeve comprising a strike face side flange, wherein the body side viewport retention sleeve is configured to connect to the ballistic glass holder sleeve, and wherein the strike face side ballistic glass holder retention sleeve is configured to connect to the ballistic glass holder sleeve.

9. The ballistic shield of claim 8, wherein the aperture insertion portion of the body side viewport retention sleeve comprises aperture insertion portion snap fit projections that are configured to mate with aperture sleeve portion snap fit projections formed on the ballistic glass holder sleeve to attach the body side viewport retention sleeve and the ballistic glass holder sleeve to the shield body.

10. The ballistic shield of claim 8, wherein the ballistic glass nest portion of the ballistic glass holder sleeve comprises ballistic glass nest portion grooves formed on an outer surface of the ballistic glass holder sleeve, wherein the ballistic glass nest portion grooves are configured to mate with glass holder nesting portion snap fit projections formed on an inside surface of the strike face side ballistic glass holder retention sleeve to attach the strike face side ballistic glass holder retention sleeve to the ballistic glass holder sleeve.

11. The ballistic shield of claim 8, wherein the body side flange is located on the body side of the shield body.

12. The ballistic shield of claim 8, wherein the strike face side flange is located on the strike face side of the shield body.

13. The ballistic shield of claim 8, wherein the ballistic glass holder sleeve comprises a strike side support flange, and wherein the strike side support flange is configured to support the piece of ballistic glass in cooperation with a ballistic glass support area of the shield body.

14. The ballistic shield of claim 8, wherein the boltless viewport assembly is configured to be assembled to the shield body without bolts, without welding, and without screws.

15. A ballistic shield comprising a boltless viewport assembly, the ballistic shield comprising a shield body having a body side and a strike face side, the shield body having a viewport aperture formed therethrough, and the boltless viewport assembly comprising:

a piece of ballistic glass;

a body side viewport retention sleeve comprising a body side flange and an aperture insertion portion that is configured to be inserted into the viewport aperture from the body side of the shield body;

a ballistic glass holder sleeve comprising an aperture sleeve portion and a ballistic glass nest portion configured to receive the piece of ballistic glass, wherein the aperture sleeve portion is configured to be inserted into the viewport aperture from the strike face side of the shield body; and a strike face side ballistic glass holder retention sleeve comprising a strike face side flange, wherein the body side viewport retention sleeve is configured to connect to the ballistic glass holder sleeve, and wherein the strike face side ballistic glass holder retention sleeve is configured to connect to the ballistic glass holder sleeve, and wherein the boltless viewport assembly is configured to be assembled without bolts, without welding, and without screws.

16. The ballistic shield of claim 15, wherein the aperture insertion portion of the body side viewport retention sleeve comprises aperture insertion portion snap fit projections that are configured to mate with aperture sleeve portion snap fit projections formed on the ballistic glass holder sleeve to attach the body side viewport retention sleeve and the ballistic glass holder sleeve to the shield body.

17. The ballistic shield of claim 15, wherein the ballistic glass nest portion of the ballistic glass holder sleeve comprises ballistic glass nest portion grooves formed on an outer surface of the ballistic glass holder sleeve, wherein the ballistic glass nest portion grooves are configured to mate with glass holder nesting portion snap fit projections formed on an inside surface of the strike face side ballistic glass holder retention sleeve to attach the strike face side ballistic glass holder retention sleeve to the ballistic glass holder sleeve.

18. The ballistic shield of claim 15, wherein the body side flange is located on the body side of the shield body.

19. The ballistic shield of claim 15, wherein the strike face side flange is located on the strike face side of the shield body.

20. The ballistic shield of claim 15, wherein the ballistic glass holder sleeve comprises a strike side support flange, and wherein the strike side support flange is configured to support the piece of ballistic glass in cooperation with a ballistic glass support area of the shield body.

* * * * *